US012013167B2

(12) United States Patent
Lee et al.

(10) Patent No.: US 12,013,167 B2
(45) Date of Patent: Jun. 18, 2024

(54) REFRIGERATOR

(71) Applicant: LG ELECTRONICS INC., Seoul (KR)

(72) Inventors: Donghoon Lee, Seoul (KR); Seungseob Yeom, Seoul (KR); Wookyong Lee, Seoul (KR); Yongjun Bae, Seoul (KR); Sunggyun Son, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 362 days.

(21) Appl. No.: 17/282,081

(22) PCT Filed: Oct. 1, 2019

(86) PCT No.: PCT/KR2019/012874
§ 371 (c)(1),
(2) Date: Apr. 1, 2021

(87) PCT Pub. No.: WO2020/071761
PCT Pub. Date: Apr. 9, 2020

(65) Prior Publication Data

US 2021/0372686 A1 Dec. 2, 2021

(30) Foreign Application Priority Data

Oct. 2, 2018 (KR) ..... 10-2018-0117785
Oct. 2, 2018 (KR) ..... 10-2018-0117819
(Continued)

(51) Int. Cl.
*F25C 1/25* (2018.01)
*F25C 1/10* (2006.01)
(Continued)

(52) U.S. Cl.
CPC ..... *F25C 1/25* (2018.01); *F25C 1/10* (2013.01); *F25C 1/18* (2013.01); *F25C 5/04* (2013.01);
(Continued)

(58) Field of Classification Search
CPC ..... F25C 1/25; F25C 1/10; F25C 1/18; F25C 5/04; F25C 2305/0221; F25C 2400/10;
(Continued)

(56) References Cited

U.S. PATENT DOCUMENTS 5,090,210 A * 2/1992 Katayanagi ..... F25C 1/04 62/135
6,161,390 A * 12/2000 Kim ..... F25C 5/187 62/353
(Continued)

FOREIGN PATENT DOCUMENTS

CN 1590933 A 3/2005
CN 103851877 A 6/2014
(Continued)

OTHER PUBLICATIONS

KR 20100054488 A, machine translation (Year: 2023).*
(Continued)

*Primary Examiner* — Eric S Ruppert
*Assistant Examiner* — Kirstin U Oswald
(74) *Attorney, Agent, or Firm* — KED & ASSOCIATES, LLP

(57) ABSTRACT

A refrigerator of the present invention comprises: a storage chamber for storing food; a cool air supplying means for supplying cool air to the storage chamber; a first tray which forms a part of an ice-making cell in which water is phase-changed to ice by the cool air; a second tray which forms another part of the ice-making cell and can be in
(Continued)

contact with the first tray during an ice-making process; a water supply valve for adjusting a flow of the water supplied to the ice-making cell; a water supply amount detector for detecting the amount of water supplied to the ice-making cell; and a controller for controlling the water supply valve. The controller controls the water supply valve to supply water to the ice-making cell as much as a first reference water supply amount, for supplying water to the ice-making cell at a water supply position of the second tray. After finishing the water supply as much as the first reference water supply amount, the controller moves the second tray to an ice-making position and determines whether the water supply amount of the ice-making cell has reached a target water supply amount by using the water supply amount detector. When the water supply amount of the ice making cell has reached the target water supply amount, the controller starts ice-making, and when the water supply amount of the ice making cell has not reached the target water supply amount, the controller moves the second tray back to the water supply position and controls the water supply valve to supply water as much as a second reference water supply amount which is less than the first reference water supply amount.

20 Claims, 11 Drawing Sheets

(30) Foreign Application Priority Data

| | | |
|---|---|---|
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081743 |

(51) Int. Cl.
*F25C 1/18* (2006.01)
*F25C 5/04* (2006.01)

(52) U.S. Cl.
CPC .. *F25C 2305/0221* (2021.08); *F25C 2400/10* (2013.01); *F25C 2400/14* (2013.01); *F25C 2600/04* (2013.01); *F25C 2700/04* (2013.01); *F25C 2700/12* (2013.01)

(58) Field of Classification Search
CPC ..... F25C 2400/14; F25C 2600/04; F25C 2700/04; F25C 2700/12; F25C 2400/06
USPC ..... 62/66
See application file for complete search history.

(56) References Cited

U.S. PATENT DOCUMENTS

| | | | | |
|---|---|---|---|---|
| 7,100,379 | B2 | 9/2006 | Son et al. | |
| 9,581,372 | B2 * | 2/2017 | Lee | F25C 5/08 |
| 2001/0039804 | A1 * | 11/2001 | Newman | F25C 1/12 62/66 |
| 2006/0137382 | A1 * | 6/2006 | Sasaki | F25C 1/04 62/340 |
| 2006/0201170 | A1 * | 9/2006 | Cole | F25C 1/04 62/340 |
| 2006/0242971 | A1 * | 11/2006 | Cole | F25C 1/04 62/340 |
| 2008/0072610 | A1 * | 3/2008 | Venkatakrishnan | F25C 1/04 62/135 |
| 2010/0077774 | A1 * | 4/2010 | Takagi | F25C 1/12 62/66 |
| 2010/0250005 | A1 * | 9/2010 | Hawkes | F25C 5/24 700/275 |
| 2011/0048045 | A1 | 3/2011 | An et al. | |
| 2012/0000216 | A1 * | 1/2012 | Kim | F25C 1/00 62/157 |
| 2013/0081412 | A1 | 4/2013 | Son et al. | |
| 2013/0167563 | A1 | 7/2013 | Lee et al. | |
| 2014/0038060 | A1 | 2/2014 | Abe | |
| 2014/0182325 | A1 | 7/2014 | Lee et al. | |
| 2016/0042629 | A1 * | 2/2016 | Snyder | G08B 21/088 340/573.6 |
| 2018/0100681 | A1 * | 4/2018 | Laible | F25C 1/24 |
| 2018/0231294 | A1 | 8/2018 | Song et al. | |

FOREIGN PATENT DOCUMENTS

| | | | | |
|---|---|---|---|---|
| EP | 3059526 | | | 8/2016 |
| JP | H05-203299 | | | 8/1993 |
| JP | H05-203302 | | | 8/1993 |
| JP | H0670543 | | | 9/1994 |
| JP | H07218071 | A | | 8/1995 |
| JP | H09-269172 | | | 10/1997 |
| JP | 2003-114072 | | | 4/2003 |
| JP | 2003-232587 | | | 8/2003 |
| JP | 2003232587 | A | * | 8/2003 |
| JP | 2005-326035 | | | 11/2005 |
| JP | 4572833 | | | 11/2010 |
| JP | 2011-064371 | | | 3/2011 |
| JP | 2011-064373 | | | 3/2011 |
| JP | 2011-237077 | | | 11/2011 |
| JP | 06-070543 | | | 2/2017 |
| KR | 10-2005-0069319 | | | 7/2005 |
| KR | 10-2005-0096336 | | | 10/2005 |
| KR | 100756993 | B1 | * | 9/2007 |
| KR | 10-2009-0079377 | | | 7/2009 |
| KR | 10-2010-0054488 | | | 5/2010 |
| KR | 10-2012-0003233 | | | 1/2012 |
| KR | 10-2013-0009332 | | | 1/2013 |
| KR | 10-2013-0009521 | | | 1/2013 |
| KR | 20130033045 | A | * | 4/2013 |
| KR | 20130033045 | A | * | 5/2013 |
| KR | 10-2014-0088321 | | | 7/2014 |
| KR | 10-1643635 | | | 7/2016 |
| KR | 10-1850918 | | | 5/2018 |
| KR | 10-2018-0100752 | | | 9/2018 |

OTHER PUBLICATIONS

JP 2003232587 A, machine translation (Year: 2023).*
KR100756993B1, machine translation (Year: 2023).*
Korean Office Action dated May 1, 2023 issued in Application No. 10-2018-0117785.
Korean Office Action dated May 8, 2023 issued in Application No. 10-2018-0117819.
Korean Office Action dated May 14, 2023 issued in Application No. 10-2018-0117821.
Korean Office Action dated May 15, 2023 issued in Application No. 10-2018-0117822.
International Search Report (with English Translation) dated Jan. 30, 2020 issued in Application No. PCT/KR2019/012874.
Chinese Office Action dated May 20, 2022 issued in Application 201980063701.0.
Korean Notice of Allowance dated Nov. 7, 2023 issued in Application No. 10-2018-0117821.
Korean Notice of Allowance dated Jan. 10, 2024 issued in Application No. 10-2018-0142117.
Korean Notice of Allowance dated Feb. 22, 2024, issued in Application No. 10-2018-0117785.
Korean Office Action dated Mar. 12, 2024, issued in Application No. 10-2018-0117822.

* cited by examiner

REFRIGERATOR

CROSS-REFERENCE TO RELATED PATENT APPLICATIONS

This application is a U.S. National Stage Application under 35 U.S.C. § 371 of PCT Application No. PCT/KR2019/012874, filed Oct. 1, 2019, which claims priority to Korean Patent Application Nos. 10-2018-0117785, filed Oct. 2, 2018; 10-2018-0117819 filed Oct. 2, 2018; 10-2018-0117821, filed Oct. 2, 2018; 10-2018-0117822, filed Oct. 2, 2018; 10-2018-0142117, filed Nov. 16, 2018; and 10-2019-0081743, filed Jul. 6, 2019, whose entire disclosures are hereby incorporated by reference.

TECHNICAL FIELD

The present disclosure relates to a refrigerator.

BACKGROUND ART

In general, refrigerators are home appliances for storing food at a low temperature in a storage space that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray.

The ice maker separates the made ice from the ice tray in a heating manner or twisting manner.

The ice maker through which water is automatically supplied, and the ice automatically separated may be, for example, opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Registration No. 10-1850918 (hereinafter, referred to as a "prior art document 1") that is a prior art document.

The ice maker disclosed in the prior art document 1 includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the prior art document 1, although the spherical ice is made by the hemispherical upper cell and the hemispherical lower cell, since the ice is made at the same time in the upper and lower cells, bubbles containing water are not completely discharged but are dispersed in the water to make opaque ice.

An ice maker is disclosed in Japanese Patent Laid-Open No. 9-269172 (hereinafter, referred to as a "prior art document 2") that is a prior art document.

The ice maker disclosed in the prior art document 2 includes an ice making plate and a heater for heating a lower portion of water supplied to the ice making plate.

In the case of the ice maker disclosed in the prior art document 2, water on one surface and a bottom surface of an ice making block is heated by the heater in an ice making process. Thus, when solidification proceeds on the surface of the water, and also, convection occurs in the water to make transparent ice.

When growth of the transparent ice proceeds to reduce a volume of the water within the ice making block, the solidification rate is gradually increased, and thus, sufficient convection suitable for the solidification rate may not occur.

Thus, in the case of the prior art document 2, when about ⅔ of water is solidified, a heating amount of heater increases to suppress an increase in the solidification rate.

However, according to the prior art document 2, when only the volume of water is reduced, the heating amount of heater may increase, and thus, it may be difficult to make ice having uniform transparency according to shapes of ice.

DISCLOSURE

Technical Problem

Embodiments provide a refrigerator which is capable of making ice having uniform transparency as a whole regardless of shapes of the ice and a method for manufacturing the same.

Embodiments also provide a refrigerator which is capable of generating ice having the same shape as an ice making cell by accurately supplying water as much as a target water supply amount and a method for manufacturing the same.

Embodiments also provide a refrigerator in which transparency for each unit height of generated ice is uniform and a method for manufacturing the same.

Technical Solution

A refrigerator according to one aspect includes: a first tray configured to define one portion of an ice making cell that is a space in which water is phase-changed into ice by cold air supplied by a cold air supply part; a second tray configured to define the other portion of the ice making cell; a water supply valve configured to adjust a flow of water supplied to the ice making cell; a water supply amount detection part configured to detect a water supply amount to the ice making cell, and a controller configured to control the water supply valve.

The controller may control the water supply valve so that water as much as a first reference water supply amount is supplied to the ice making cell so as to supply water to the ice making cell at a water supply position of the second tray.

The controller may control the second tray to move to an ice making position after the supply of water as much as the first reference water supply amount is completed and determines whether the water supply amount to the ice making cell reaches a target water supply amount, by using a water supply amount detection part.

The controller may control so that the ice making starts when the water supply amount to the ice making cell reaches the target water supply amount, and may control the water supply position to supply water as much as a second reference water supply amount less than the first reference water supply amount after the second tray moving again to the water supply position when the water supply amount to the ice making cell does not reach the target water supply amount. When the ice making starts, the cold air of the cold air supply part may be supplied to the ice making cell.

After completely supplying water as much as the second reference water supply amount, the controller may control the second tray to move to an ice making position and determine whether the water supply amount to the ice making cell reaches the target water supply amount, by the water supply amount detection part.

When the water supply amount to the ice making cell reaches the target water supply amount, the controller may control the ice making to start. When the water supply amount to the ice making cell does not reach the target water supply amount, the additional water supply as much as the second reference water supply amount is repetitively performed until the water supply amount to the ice making cell reaches the target water supply amount.

The water supply amount detection part may be disposed to be exposed to the ice making cell. An end of the water supply amount detection part may be disposed lower than an end of the ice making cell.

The second tray may be connected to the driver. The controller may control the driver.

The controller may control the second tray to move from the water supply position to the ice making position in a reverse direction. The controller may control the second tray to move to an ice separation position in a forward direction so as to take ice out of the ice making cell after the generation of the ice in the ice making cell is completed. The controller may control the second tray to move from the ice separation position to the water supply position in the reverse direction after the ice separation is completed so as to supply the water.

The water supply amount detection part may include a temperature sensor configured to detect a temperature of the ice making cell.

After the second tray moves to the water supply position after the ice separation is completed, the controller may control the water supply valve so that the water as much as the first reference water supply amount is supplied to the ice making cell if a temperature detected by the temperature sensor reaches a water supply start temperature.

The controller may determine that the water supply amount to the ice making cell reaches the target water supply amount when the temperature detected by the temperature sensor reaches a reference temperature that is above zero.

The water supply amount detection part may include a capacitive sensor that outputs different signals according to whether the ice making cell is in contact with water.

When the capacitive sensor is in contact with the water, a first signal may be output, and when the capacitive sensor is not in contact with the water, a second signal may be output.

The controller may determine that the water supply amount to the ice making cell reaches the target water supply amount when the first signal is output from the capacitive sensor.

The first reference water supply amount may be equal to or greater than 80% of the target water supply amount, and the second reference water supply amount may be equal to or less than 20% of the target water supply amount. The first reference water supply amount may be equal to or greater than 90% of the target water supply amount, and the second reference water supply amount may range of 1% to 10% of the target water supply amount.

A heater may be disposed adjacent to at least one of the first tray or the second tray. The controller may control the heater.

The refrigerator may further include a cold air supply part to supply cold air to the ice making cell.

The controller may control the heater to be turned on in at least partial section while the cold air supply part supplies the cold air so that bubbles dissolved in the water within the ice making cell moves from a portion, at which the ice is generated, toward the water that is in a liquid state to generate transparent ice.

The controller may control one or more of cooling power of the cold air supply part and the heating amount of heater to vary according to a mass per unit height of water in the ice making cell.

A method for controlling a refrigerator, which includes a first tray configured to define one portion of an ice making cell; a second tray configured to define the other portion of the ice making cell, a water supply valve configured to adjust a flow of water supplied to the ice making cell, a water supply amount detection part configured to detect a water supply amount to the ice making cell, and a controller configured to control the water supply valve, includes: moving the second tray to a water supply position; controlling the water supply valve so that water as much as a first reference water supply amount is supplied to the ice making cell so as to supply water to the ice making cell at the water supply position of the second tray, controlling the second tray to move to an ice making position after the supply of water as much as the first reference water supply amount is completed and determining whether the water supply amount to the ice making cell reaches a target water supply amount, by using a water supply amount detection part, and controlling the water supply valve to supply water as much as a second reference water supply amount less than the first reference water supply amount after the second tray moving again to the water supply position when the water supply amount to the ice making cell does not reach the target water supply amount. When the water supply amount to the ice making cell reaches the target water supply amount, the water supply may be completed, and the ice making may start.

Advantageous Effects

According to the embodiments, since the heater is turned on in at least a portion of the sections while the cold air supply part supplies cold air, the ice making rate may be delayed by the heat of the heater so that the bubbles dissolved in the water inside the ice making cell move toward the liquid water from the portion at which the ice is made, thereby making the transparent ice.

Particularly, according to the embodiments, one or more of the cooling power of the cold air supply part and the heating amount of heater may be controlled to vary according to the mass per unit height of water in the ice making cell to make the ice having the uniform transparency as a whole regardless of the shape of the ice making cell.

In addition, in the case of this embodiment, since the water is accurately supplied as much as the target water supply amount, the ice having the same shape as the ice making cell may be generated.

Also, the heating amount of transparent ice heater and/or the cooling power of the cold air supply part may vary in response to the change in the heat transfer amount between the water in the ice making cell and the cold air in the storage chamber, thereby making the ice having the uniform transparency as a whole.

MODE FOR INVENTION

Figure 1B:
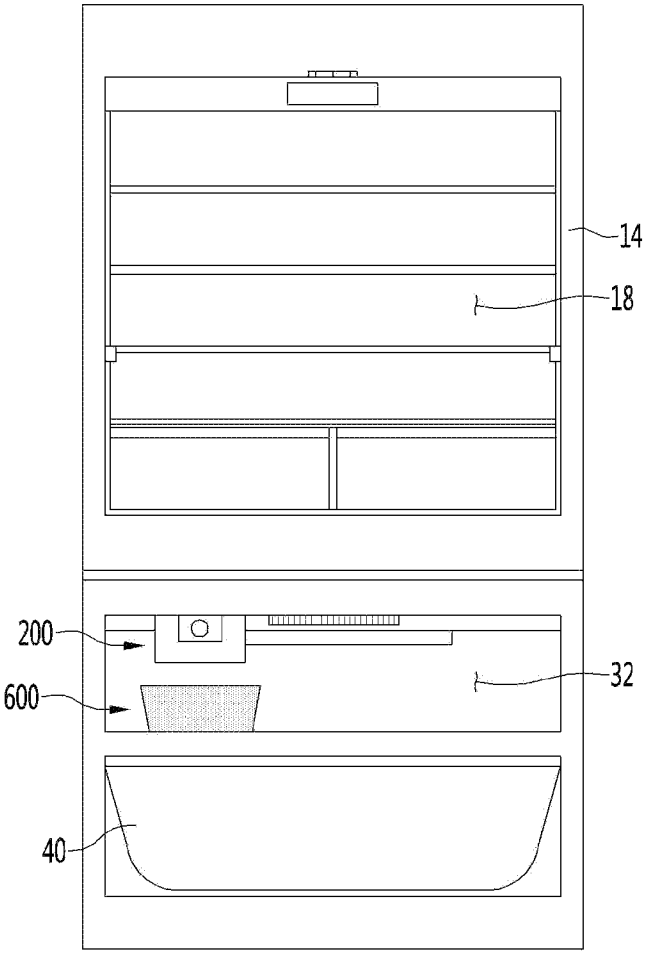
FIG. 1 is a front view of a refrigerator according to an embodiment of the present invention.

Hereinafter, some embodiments of the present invention will be described in detail with reference to the accompanying drawings. Exemplary embodiments of the present invention will be described below in more detail with reference to the accompanying drawings. It is noted that the same or similar components in the drawings are designated by the same reference numerals as far as possible even if they are shown in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 1A:
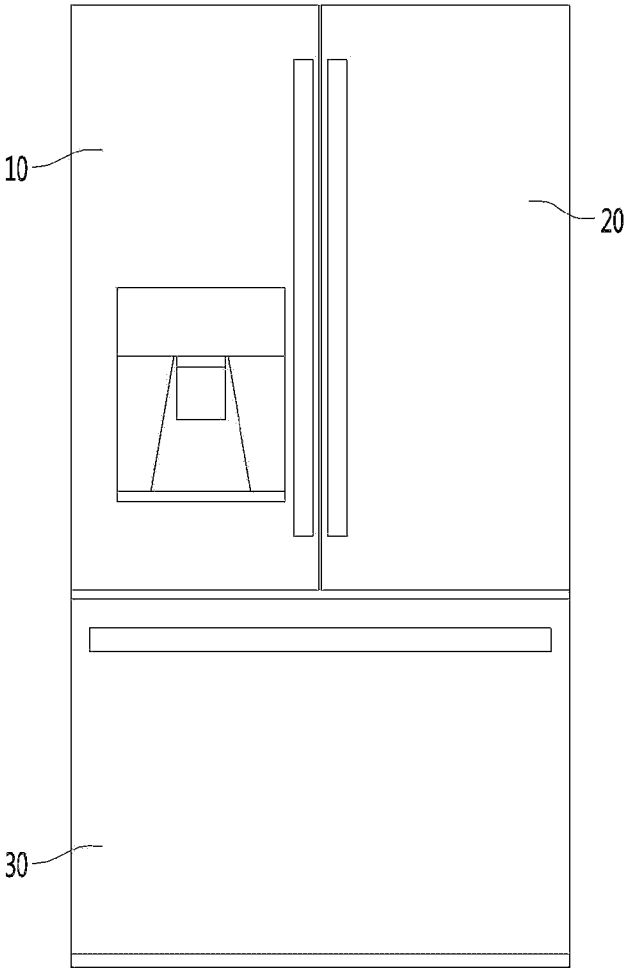

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 14 is disposed at an upper side, and the freezing compartment 32 is disposed at a lower side. Each of the storage chamber may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner. The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 drops to be stored may be disposed below the ice maker 200. A user may take out the ice bin 600 from the freezing compartment 32 to use the ice stored in the ice bin 600. The ice bin 600 may be mounted on an upper side of a horizontal wall that partitions an upper space and a lower space of the freezing compartment 32 from each other.

Although not shown, the cabinet 14 is provided with a duct supplying cold air to the ice maker 200. The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct. Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

Figure 2:
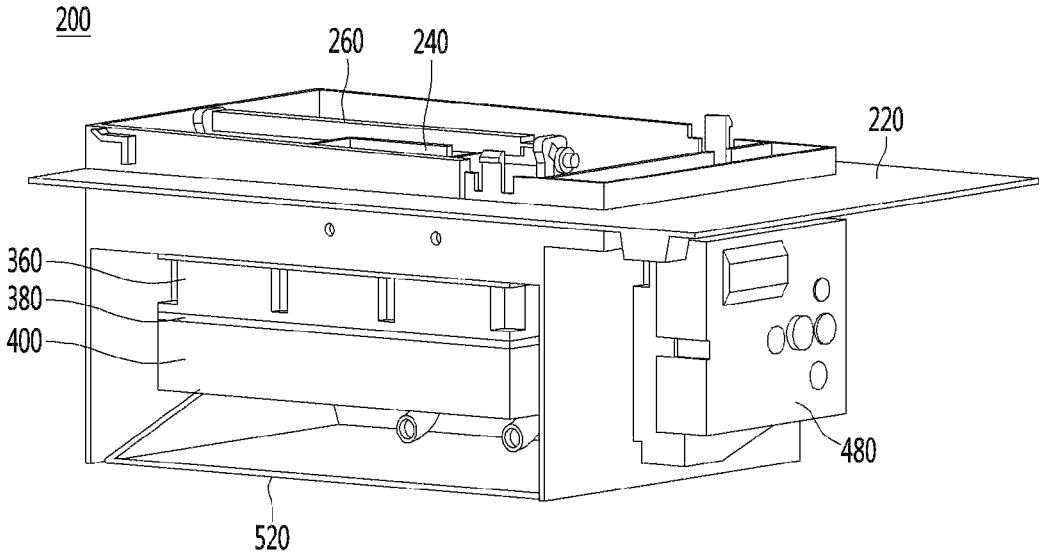
FIG. 2 is a perspective view of an ice maker according to an embodiment of the present invention.
Figure 3:
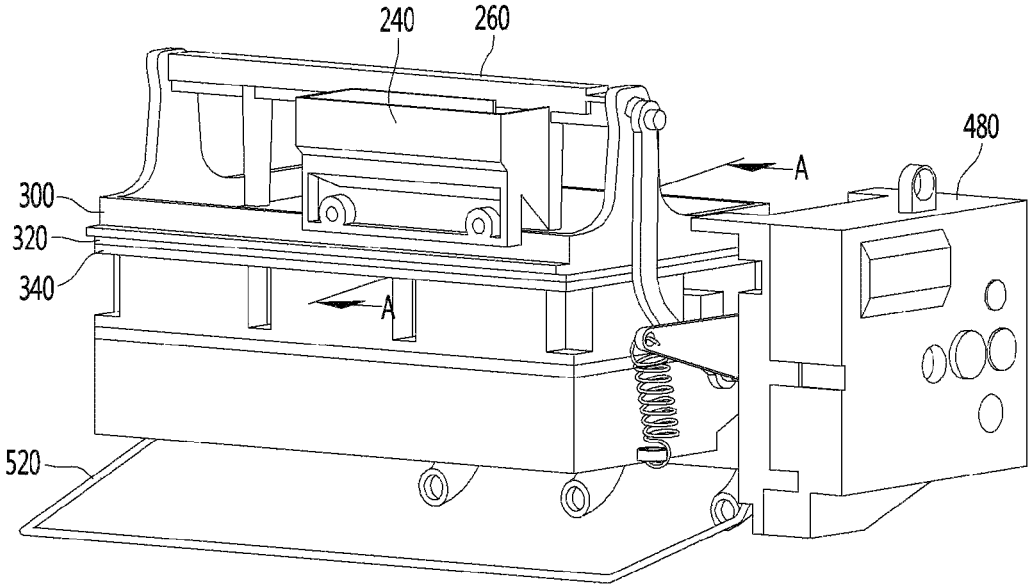
FIG. 3 is a perspective view illustrating a state in which a bracket is removed from the ice maker of FIG. 2.
Figure 4:
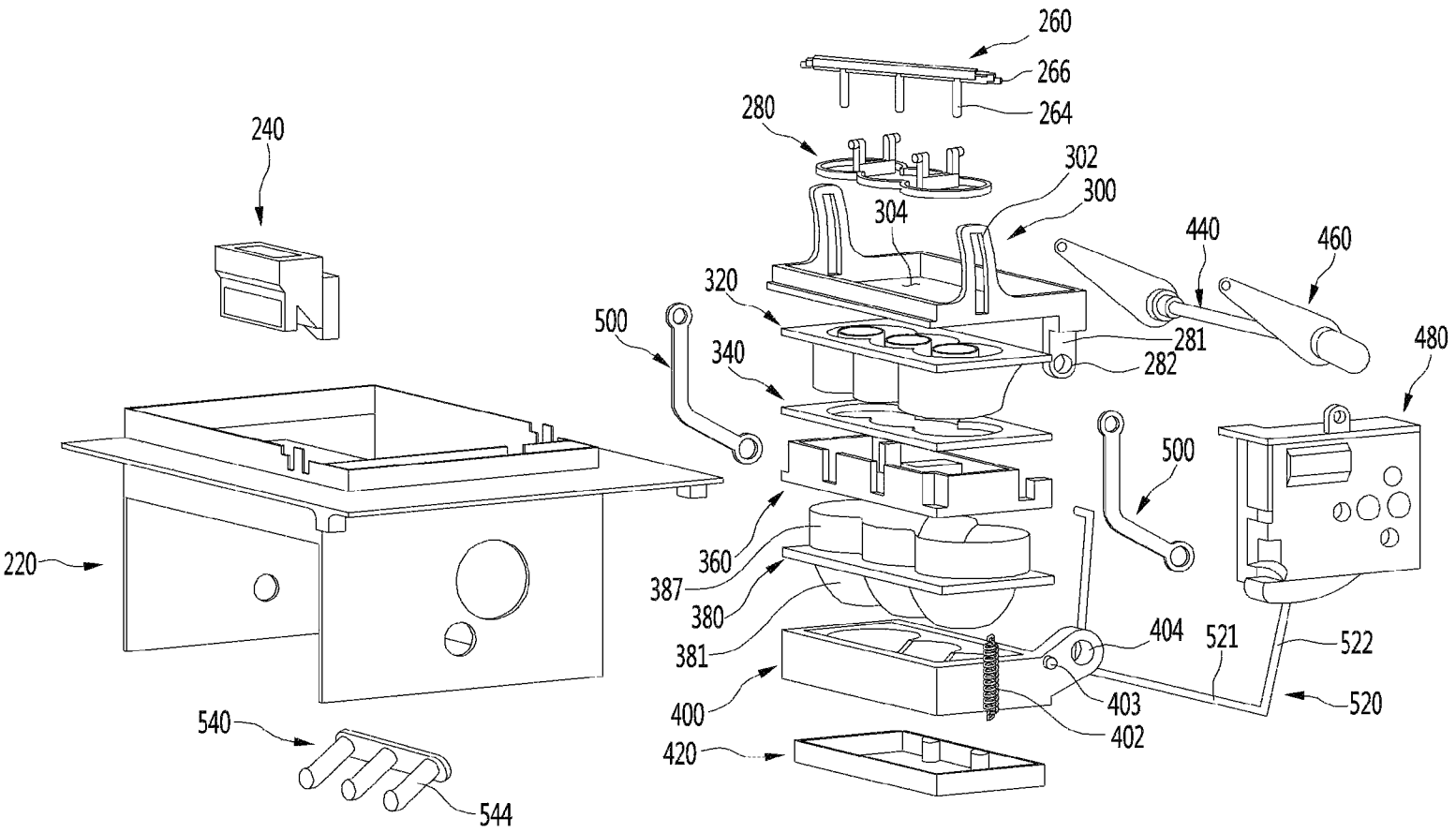
FIG. 4 is an exploded perspective view of the ice maker according to an embodiment of the present invention.

FIG. 2 is a perspective view of the ice maker according to an embodiment, FIG. 3 is a perspective view illustrating a state in which the bracket is removed from the ice maker of FIG. 2, and FIG. 4 is an exploded perspective view of the ice maker according to an embodiment.

Figure 5:
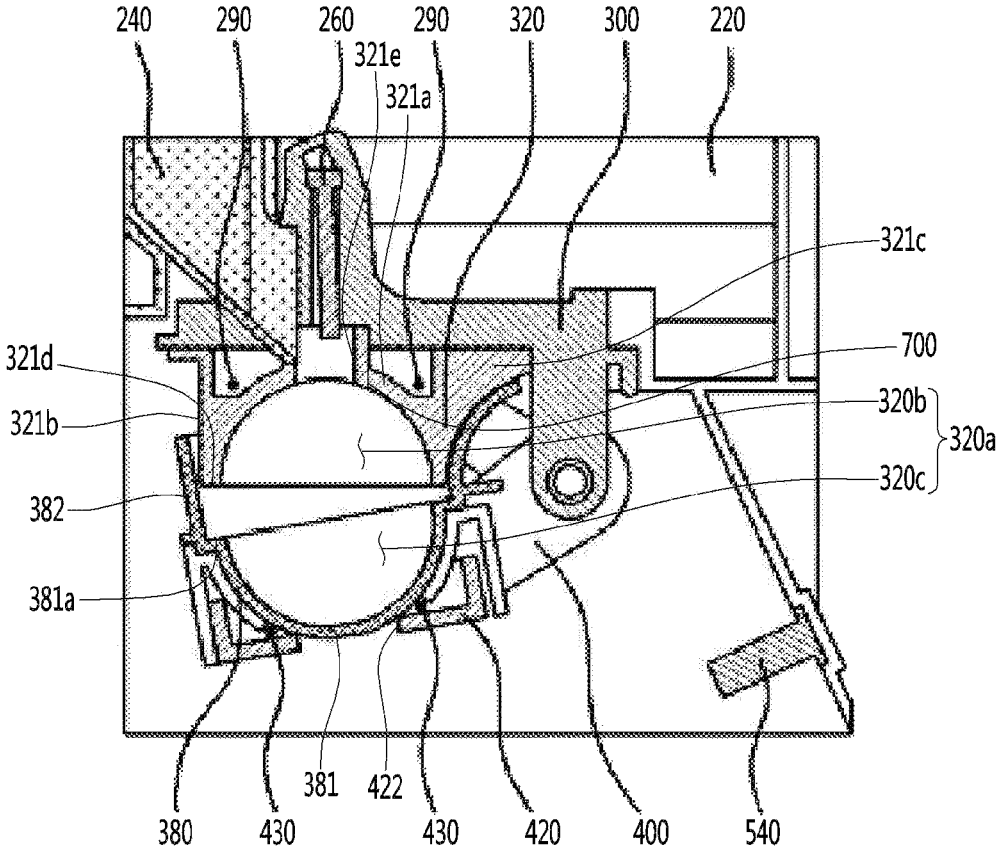
FIG. 5 is a sectional view taken along line A-A of FIG. 3.

FIG. 5 is a sectional view taken along line A-A of FIG. 3. FIG. 5 illustrates a state in which a second tray is disposed at a water supply position.

Referring to FIGS. 2 to 5, each component of the ice maker 200 may be provided inside or outside the bracket 220, and thus, the ice maker 200 may constitute one assembly.

The bracket 220 may be installed at, for example, the upper wall of the freezing compartment 32. The water supply part 240 may be installed on an upper side of an inner surface of the bracket 220. The water supply part 240 may be provided with an opening in each of an upper side and a lower side to guide water, which is supplied to an upper side of the water supply part 240, to a lower side of the water supply part 240. The upper opening of the water supply part 240 may be greater than the lower opening to limit a discharge range of water guided downward through the water supply part 240. A water supply pipe through which water is supplied may be installed to the upper side of the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

The ice maker 200 may include an ice making cell 320*a* in which water is phase-changed into ice by the cold air.

The ice maker 200 may include a first tray 320 defining at least a portion of a wall providing the ice making cell 320*a* and a second tray 380 defining at least the other portion of a wall providing the ice making cell 320*a*. Although not limited, the ice making cell 320*a* may include a first cell 320*b* and a second cell 320*c*. The first tray 320 may define the first cell 320*b*, and the second tray 380 may define the second cell 320*c*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 are in contact with each other, the complete ice making cell see 320*a* may be defined.

On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is defined. Accordingly, the first tray 320 may be referred to as an upper tray, and the second tray 380 may be referred to as a lower tray.

A plurality of ice making cells 320*a* may be defined by the first tray 320 and the second tray 380.

When water is cooled by cold air while water is supplied to the ice making cell 320*a*, ice having the same or similar shape as that of the ice making cell 320*a* may be made.

In this embodiment, for example, the ice making cell 320*a* may be provided in a spherical shape or a shape similar to a spherical shape. In this case, the first cell 320*b* may be provided in a hemisphere shape or a shape similar to the hemisphere. Also, the second cell 320*c* may be provided in a hemisphere shape or a shape similar to the hemisphere. The ice making cell 320*a* may have a rectangular parallelepiped shape or a polygonal shape.

The ice maker 200 may further include a first tray case 300 coupled to the first tray 320.

For example, the first tray case 300 may be coupled to an upper side of the first tray 320. The first tray case 300 may be manufactured as a separate part from the bracket 220 and then may be coupled to the bracket 220 or integrally formed with the bracket 220.

The ice maker 200 may further include a first heater case 280. An ice separation heater 290 may be installed in the second heater case 280. The heater case 280 may be integrally formed with the first tray case 300 or may be separately formed.

The ice separation heater 290 may be disposed at a position adjacent to the first tray 320. For example, the ice separation heater 290 may be a wire-type heater. For example, the ice separation heater 290 may be installed to contact the second tray 320 or may be disposed at a position spaced a predetermined distance from the second tray 320. In some cases, the ice separation heater 290 may supply heat to the first tray 320, and the heat supplied to the first tray 320 may be transferred to the ice making cell 320*a*.

The ice maker 200 may further include a first tray cover 340 disposed below the first tray 320. The first tray cover 340 may be provided with an opening corresponding to a shape of the ice making cell 320*a* of the first tray 320 and may be coupled to a bottom surface of the first tray 320.

The first tray case 300 may be provided with a guide slot 302 which is inclined at an upper side and vertically extended at a lower side thereof. The guide slot 302 may be provided in a member extending upward from the first tray case 300.

A guide protrusion 262 of the first pusher 260 to be described later may be inserted into the guide slot 302. Thus, the guide protrusion 262 may be guided along the guide slot 302.

The first pusher 260 may include at least one extension part 264. For example, the first pusher 260 may include an extension part 264 provided with the same number as the number of ice making cells 320*a*, but is not limited thereto. The extension part 264 may push out the ice disposed in the ice making cell 320*a* during the ice separation process. Accordingly, the extension part 264 may be inserted into the ice making cell 320*a* through the first tray case 300. Therefore, the first tray case 300 may be provided with a through-hole 304 through which a portion of the first pusher 260 passes.

The guide protrusion 262 of the first pusher 260 may be coupled to the pusher link 500. In this case, the guide protrusion 262 may be coupled to the pusher link 500 so as to be rotatable. Therefore, when the pusher link 500 moves, the first pusher 260 may also move along the guide slot 302.

The ice maker 200 may further include a second tray case 400 coupled to the second tray 380. The second tray case 400 may be disposed at a lower side of the second tray to support the second tray 380. For example, at least a portion of the wall defining a second cell 320*c* of the second tray 380 may be supported by the second tray case 400.

A spring 402 may be connected to one side of the second tray case 400. The spring 402 may provide elastic force to the second tray case 400 to maintain a state in which the second tray 380 contacts the first tray 320.

The ice maker 200 may further include a second tray cover 360.

The second tray 380 may include a circumferential wall 382 surrounding a portion of the first tray 320 in a state of contacting the first tray 320. The second tray cover 360 may surround the circumferential wall 382.

The ice maker 200 may further include a second heater case 420. A transparent ice heater 430 may be installed in the second heater case 420.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which an ice making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

Alternatively, at least one of the first tray 320 and the second tray 380 may be made of a resin including plastic so that the ice attached to the trays 320 and 380 is separated in the ice making process.

At least one of the first tray 320 or the second tray 380 may be made of a flexible or soft material so that the tray deformed by the pushers 260 and 540 is easily restored to its original shape in the ice separation process.

The transparent ice heater 430 may be disposed at a position adjacent to the second tray 380. For example, the transparent ice heater 430 may be a wire-type heater. For example, the transparent ice heater 430 may be installed to contact the second tray 380 or may be disposed at a position spaced a predetermined distance from the second tray 380. For another example, the second heater case 420 may not be separately provided, but the transparent heater 430 may be installed on the second tray case 400. In some cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480.

A through-hole 282 may be defined in an extension part 281 extending downward in one side of the first tray case 300. A through-hole 404 may be defined in the extension part 403 extending in one side of the second tray case 400. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480. Alternatively, the rotation arm may be connected to the driver 480 to rotate by receiving rotational force from the driver 480. In this case, the shaft 440 may be connected to the rotation arm, which is not connected to the driver 480, of the pair of rotation arms 460 to transmit the rotational force.

One end of the rotation arm 460 may be connected to one end of the spring 402, and thus, a position of the rotation arm 460 may move to an initial value by restoring force when the spring 402 is tensioned.

The driver 480 may include a motor and a plurality of gears.

A full ice detection lever 520 may be connected to the driver 480. The full ice detection lever 520 may also rotate by the rotational force provided by the driver 480.

The full ice detection lever 520 may have a 'E' shape as a whole. For example, the full ice detection lever 520 may include a first portion 521 and a pair of second portions 522 extending in a direction crossing the first portion 521 at both ends of the first portion 521. One of the pair of second portions 522 may be coupled to the driver 480, and the other may be coupled to the bracket 220 or the first tray case 300. The full ice detection lever 520 may rotate to detect ice stored in the ice bin 600.

The driver 480 may further include a cam that rotates by the rotational power of the motor.

The ice maker 200 may further include a sensor that senses the rotation of the cam.

For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal.

The controller 800 to be described later may determine a position of the second tray 380 based on the type and pattern of the signal outputted from the sensor. That is, since the second tray 380 and the cam rotate by the motor, the position of the second tray 380 may be indirectly determined based on a detection signal of the magnet provided in the cam.

For example, a water supply position and an ice making position, which will be described later, may be distinguished and determined based on the signals outputted from the sensor.

The ice maker 200 may further include a second pusher 540. The second pusher 540 may be installed on the bracket 220.

The second pusher 540 may include at least one extension part 544. For example, the second pusher 540 may include an extension part 544 provided with the same number as the number of ice making cells 320*a*, but is not limited thereto. The extension part 544 may push the ice disposed in the ice making cell 320*a*. For example, the extension part 544 may pass through the second tray case 400 to contact the second tray 380 defining the ice making cell and then press the contacting second tray 380. Therefore, the second tray case 400 may be provided with a hole 422 through which a portion of the second pusher 540 passes.

The first tray case 300 may be rotatably coupled to the second tray case 400 with respect to the second tray supporter 400 and then be disposed to change in angle about the shaft 440.

In this embodiment, the second tray 380 may be made of a non-metal material. For example, when the second tray 380 is pressed by the second pusher 540, the second tray 380 may be made of a flexible or soft material which is deformable. Although not limited, the second tray 380 may be made of, for example, a silicone material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380.

Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

For another example, the first tray 320 may be made of a metal material. In this case, since the coupling force or the attaching force between the first tray 320 and the ice is strong, the ice maker 200 according to this embodiment may include at least one of the ice separation heater 290 or the first pusher 260.

For another example, the first tray 320 may be made of a non-metallic material. When the first tray 320 is made of the non-metallic material, the ice maker 200 may include only one of the ice separation heater 290 and the first pusher 260. Alternatively, the ice maker 200 may not include the ice separation heater 290 and the first pusher 260. Although not limited, the first tray 320 may be made of, for example, a silicone material. That is, the first tray 320 and the second tray 380 may be made of the same material.

When the first tray 320 and the second tray 380 are made of the same material, the first tray 320 and the second tray 380 may have different hardness to maintain sealing performance at the contact portion between the first tray 320 and the second tray 380.

In this embodiment, since the second tray 380 is pressed by the second pusher 540 to be deformed, the second tray 380 may have hardness less than that of the first tray 320 to facilitate the deformation of the second tray 380.

Referring to FIG. 5, the ice maker 200 according to this embodiment may be designed so that a position of the second tray 380 is different from the water supply position and the ice making position.

For example, the second tray 380 may include a second cell wall 381 defining a second cell 320*c* of the ice making cell 320*a* and a circumferential wall 382 extending along an outer edge of the second cell wall 381.

The second cell wall 381 may include a top surface 381*a*. The top surface 381*a* of the second cell wall 381 may be referred to as a top surface 381*a* of the second tray 380. The top surface 381*a* of the second cell wall 381 may be disposed lower than an upper end of the circumferential wall 381.

The first tray 320 may include a first cell wall 321*a* defining a first cell 320*b* of the ice making cell 320*a*. The first cell wall 321*a* may include a straight portion 321*b* and a curved portion 321*c*. The curved portion 321*c* may have an arc shape having a radius of curvature at the center of the shaft 440. Accordingly, the circumferential wall 381 may also include a straight portion and a curved portion corresponding to the straight portion 321*b* and the curved portion 321*c*.

The first cell wall 321*a* may include a bottom surface 321*d*. The bottom surface 321*b* of the first cell wall 321*a* may be referred to herein as a bottom surface 321*b* of the first tray 320. The bottom surface 321*d* of the first cell wall 321*a* may be in contact with the top surface 381*a* of the second cell wall 381*a*.

For example, at the water supply position as illustrated in FIG. 5, at least portions of the bottom surface 321*d* of the first cell wall 321*a* and the top surface 381*a* of the second cell wall 381 may be spaced apart from each other. FIG. 5 illustrates that the entirety of the bottom surface 321*d* of the first cell wall 321*a* and the top surface 381*a* of the second cell wall 381 are spaced apart from each other.

Accordingly, the top surface 381*a* of the second cell wall 381 may be inclined to form a predetermined angle with respect to the bottom surface 321*d* of the first cell wall 321*a*.

Although not limited, the bottom surface 321*d* of the first cell wall 321*a* may be substantially horizontal at the water supply position, and the top surface 381*a* of the second cell wall 381 may be disposed below the first cell wall 321*a* to be inclined with respect to the bottom surface 321*d* of the first cell wall 321*a*.

In the state of FIG. 5, the circumferential wall 382 may surround the first cell wall 321*a*. Also, an upper end of the circumferential wall 382 may be positioned higher than the bottom surface 321*d* of the first cell wall 321*a*.

At the ice making position (see FIG. 11), the top surface 381*a* of the second cell wall 381 may contact at least a portion of the bottom surface 321*d* of the first cell wall 321*a*.

The angle formed between the top surface 381*a* of the second tray 380 and the bottom surface 321*d* of the first tray 320 at the ice making position is less than that between the top surface 382*a* of the second tray and the bottom surface 321*d* of the first tray at the water supply position. At the ice making position, the top surface 381*a* of the second cell wall 381 may contact all of the bottom surface 321*d* of the first cell wall 321*a*.

At the ice making position, the top surface 381*a* of the second cell wall 381 and the bottom surface 321*d* of the first cell wall 321*a* may be disposed to be substantially parallel to each other.

In this embodiment, the water supply position of the second tray 380 and the ice making position are different from each other. This is done for uniformly distributing the water to the plurality of ice making cells 320*a* without providing a water passage for the first tray 320 and/or the second tray 380 when the ice maker 200 includes the plurality of ice making cells 320*a*.

If the ice maker 200 includes the plurality of ice making cells 320*a*, when the water passage is provided in the first tray 320 and/or the second tray 380, the water supplied into the ice maker 200 may be distributed to the plurality of ice making cells 320*a* along the water passage.

However, when the water is distributed to the plurality of ice making cells 320*a*, the water also exists in the water passage, and when ice is made in this state, the ice made in the ice making cells 320*a* may be connected by the ice made in the water passage portion.

In this case, there is a possibility that the ice sticks to each other even after the completion of the ice, and even if the ice is separated from each other, some of the plurality of ice includes ice made in a portion of the water passage. Thus, the ice may have a shape different from that of the ice making cell.

However, like this embodiment, when the second tray 380 is spaced apart from the first tray 320 at the water supply position, water dropping to the second tray 380 may be uniformly distributed to the plurality of second cells 320*c* of the second tray 380.

For example, the first tray 320 may include a communication hole 321*e*. When the first tray 320 includes one first cell 320*b*, the first tray 320 may include one communication hole 321*e*. When the first tray 320 includes a plurality of first cells 320*b*, the first tray 320 may include a plurality of communication holes 321*e*. The water supply part 240 may supply water to one communication hole 321*e* of the plurality of communication holes 321*e*. In this case, the water supplied through the one communication hole 321*e* drops to the second tray 380 after passing through the first tray 320.

In the water supply process, water may drop into any one of the second cells 320*c* of the plurality of second cells 320*c* of the second tray 380. The water supplied to one of the second cells 320*c* may overflow from the one of the second cells 320*c*.

In this embodiment, since the top surface 381*a* of the second tray 380 is spaced apart from the bottom surface 321*d* of the first tray 320, the water overflowed from any one of the second cells 320*c* may move to the adjacent other second ell 320*c* along the top surface 381*a* of the second tray 380. Therefore, the plurality of second cells 320*c* of the second tray 380 may be filled with water.

Also, in the state in which water supply is completed, a portion of the water supplied may be filled in the second cell 320*c*, and the other portion of the water supplied may be filled in the space between the first tray 320 and the second tray 380.

When the second tray 380 move from the water supply position to the ice making position, the water in the space between the first tray 320 and the second tray 380 may be uniformly distributed to the plurality of first cells 320*b*.

When water passages are provided in the first tray 320 and/or the second tray 380, ice made in the ice making cell 320*a* may also be made in a portion of the water passage.

In this case, when the controller of the refrigerator controls one or more of the cooling power of the cold air supply part 900 and the heating amount of the transparent ice heater to vary according to the mass per unit height of the water in the ice making cell 320*a*, one or more of the cooling power of the cold air supply part 900 and the heating amount of the transparent ice heater may be abruptly changed several times or more in the portion at which the water passage is provided.

This is because the mass per unit height of the water increases more than several times in the portion at which the water passage is provided. In this case, reliability problems of components may occur, and expensive components having large maximum output and minimum output ranges may be used, which may be disadvantageous in terms of power consumption and component costs. As a result, the present invention may require the technique related to the aforementioned ice making position to make the transparent ice.

The first tray 320 may further include a storage chamber wall 321*f* disposed along a circumference of the communication hole 321*f*. The storage chamber wall 321*f* may define an auxiliary storage chamber. The auxiliary storage chamber may be disposed above the ice making cell 320*a*. The auxiliary storage chamber serves to prevent water in the ice making cell 320*a* from overflowing to the outside through the communication hole 321*e*.

The refrigerator may further include a second temperature sensor 700 (or ice making cell temperature sensor). The second temperature sensor 700 may sense a temperature of water or ice of the ice making cell 320*a*.

The second temperature sensor 700 may be disposed adjacent to the first tray 320 to sense the temperature of the first tray 320, thereby indirectly determining the water temperature or the ice temperature of the ice making cell 320*a*. Alternatively, the second temperature sensor 700 may be exposed from the second tray 320 to the ice making cell 320*a* to directly detect a temperature of the ice making cell 320*a*. In this embodiment, the temperature of the ice making cell 320*a* may be a temperature of water, ice, or cold air.

In this embodiment, the second temperature sensor 700 may be used to determine whether an amount of water supplied to the ice making cell 320*a* reaches a target water supply amount.

The second temperature sensor 700 may be disposed adjacent to an upper end of the ice making cell 320*a*. The upper end of the ice making cell 320*a* may be a portion in which the communication hole 321*e* of the first tray 320 is formed.

The lowermost end of the second temperature sensor 700 may be disposed lower than the upper end of the ice making cell 320*a*. When the lowermost end of the second temperature sensor 700 is disposed lower than the upper end of the ice making cell 320*a*, in a state in which water is supplied to the ice making cell 320*a* as much as the target water supply amount, the uppermost end of the supplied water may be lower than the upper end of the ice making cell 320*a*.

Since water expands in the process of being phase-changed into ice, if the uppermost end of the supplied water is equal to or higher than the upper end of the ice making cell 320*a*, a portion of the expanded ice is disposed in the auxiliary storage chamber. As a result, there are problems that the ice is not easily separated from the first tray 320, and also, the shape of the ice is not the same as the shape of the ice making cell 320*a*. However, according to the present invention, the problems may be prevented in advance.

Figure 6:
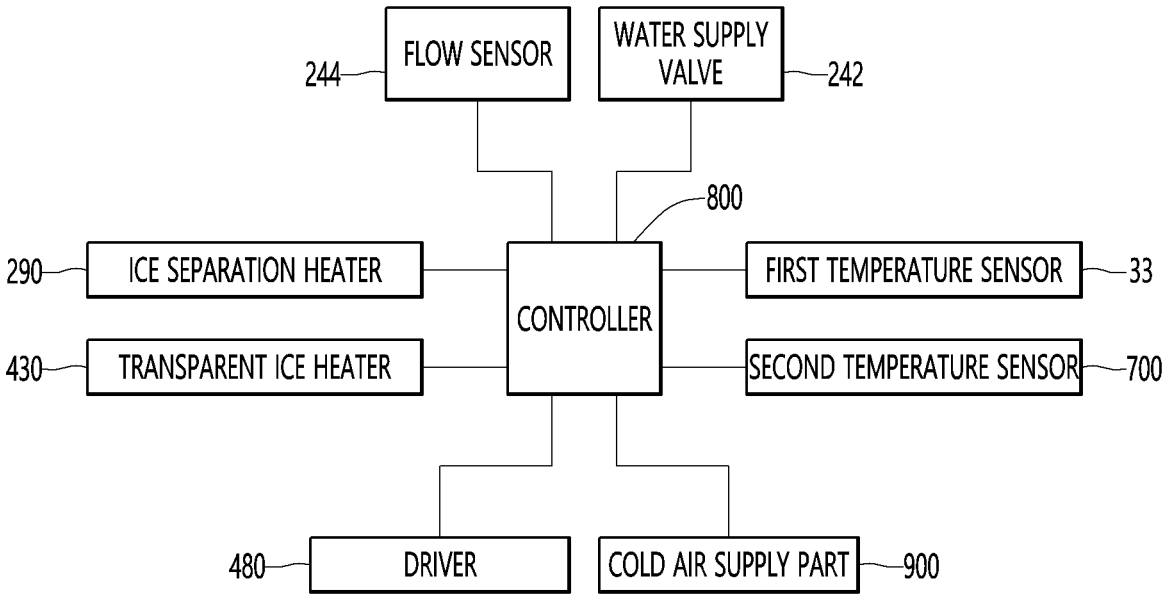
FIG. 6 is a control block diagram of a refrigerator according to an embodiment of the present invention.

FIG. 6 is a control block diagram of the refrigerator according to an embodiment.

Referring to FIG. 6, the refrigerator according to this embodiment may include an air supply part 900 supplying cold air to the freezing compartment 32 (or the ice making cell). The cold air supply part 900 may supply cold air to the freezing compartment 32 using a refrigerant cycle.

For example, the cold air supply part 900 may include a compressor compressing the refrigerant. A temperature of the cold air supplied to the freezing compartment 32 may vary according to the output (or frequency) of the compressor.

Alternatively, the cold air supply part 900 may include a fan blowing air to an evaporator. An amount of cold air supplied to the freezing compartment 32 may vary according to the output (or rotation rate) of the fan. Alternatively, the cold air supply part 900 may include a refrigerant valve controlling an amount of refrigerant flowing through the refrigerant cycle. An amount of refrigerant flowing through the refrigerant cycle may vary by adjusting an opening degree by the refrigerant valve, and thus, the temperature of the cold air supplied to the freezing compartment 32 may vary.

Therefore, in this embodiment, the cold air supply part 900 may include one or more of the compressor, the fan, and the refrigerant valve.

The refrigerator according to this embodiment may further include a controller 800 that controls the cold air supply part 900.

Also, the refrigerator may further include a flow sensor 244 for detecting an amount of water supplied through the water supply part 240 and a water supply valve 242 controlling an amount of water.

The flow sensor 244 may include an impeller equipped with a magnet, a hall sensor detecting magnetism during rotation of the impeller, and a housing in which the impeller is accommodated. When the hall sensor detects the magnetism of the magnet while the impeller rotates, or when the hall sensor and the magnet are aligned, a first signal may be output from the hall sensor. When the hall sensor does not detect the magnetism of the magnet, or the magnet is spaced a predetermined distance from the hall sensor, a second signal is output from the hall sensor.

Since the first signal (pulse) is repetitively output, it is possible to confirm the water supply amount by counting the number of first signals. Hereinafter, a comparison of the number of pulses of the first signal to the reference number will be described.

The controller 800 may control the water supply valve 242 using the counted number of first signals.

The controller 800 may control a portion or all of the ice separation heater 290, the transparent ice heater 430, the driver 480, the cold air supply part 900, and the water supply valve 242.

In this embodiment, when the ice maker 200 includes both the ice separation heater 290 and the transparent ice heater 430, an output of the ice separation heater 290 and an output of the transparent ice heater 430 may be different from each other. When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented.

Although not limited, the output of the ice separation heater 290 may be set larger than that of the transparent ice heater 430. Accordingly, ice may be quickly separated from the first tray 320 by the ice separation heater 290.

In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor that detects a temperature of the freezing compartment 32. The controller 800 may control the cold air supply part 900 based on the temperature sensed by the first temperature sensor 33.

The controller 800 may determine whether ice making is completed based on the temperature sensed by the second temperature sensor 700. Also, the controller 800 may determine whether the water supply amount reaches the target water supply amount based on the temperature detected by the second temperature sensor 700.

When an amount of water as much as the target water supply amount is supplied to the ice making cell 320*a*, the second temperature sensor 700 may be in contact with water. The temperature of the water supplied to the ice making cell 320*a* is a temperature that is above zero and may be room temperature or slightly lower than room temperature. Thus, the temperature detected by the second temperature sensor 700 may be higher than the reference temperature, which is the temperature that is above zero.

On the other hand, when an amount of water, which is less than the target water supply amount, is supplied to the ice making cell 320*a*, the cold air is disposed in a region corresponding to an insufficient water supply amount in the ice making cell 320*a*. Since the temperature of the cold air is sub-zero, the temperature detected by the second temperature sensor 700 in contact with the cold air will be lower than the reference temperature.

Thus, when the temperature detected by the second temperature sensor 700 is equal to or higher than the reference temperature, the controller 800 determines that the water supply amount of the ice making cell 320*a* reaches the target water supply amount. On the other hand, if the temperature detected by the second temperature sensor 700 is less than the reference temperature, it is determined that the water supply amount of the ice making cell 320*a* does not reach the target water supply amount.

Figure 7:
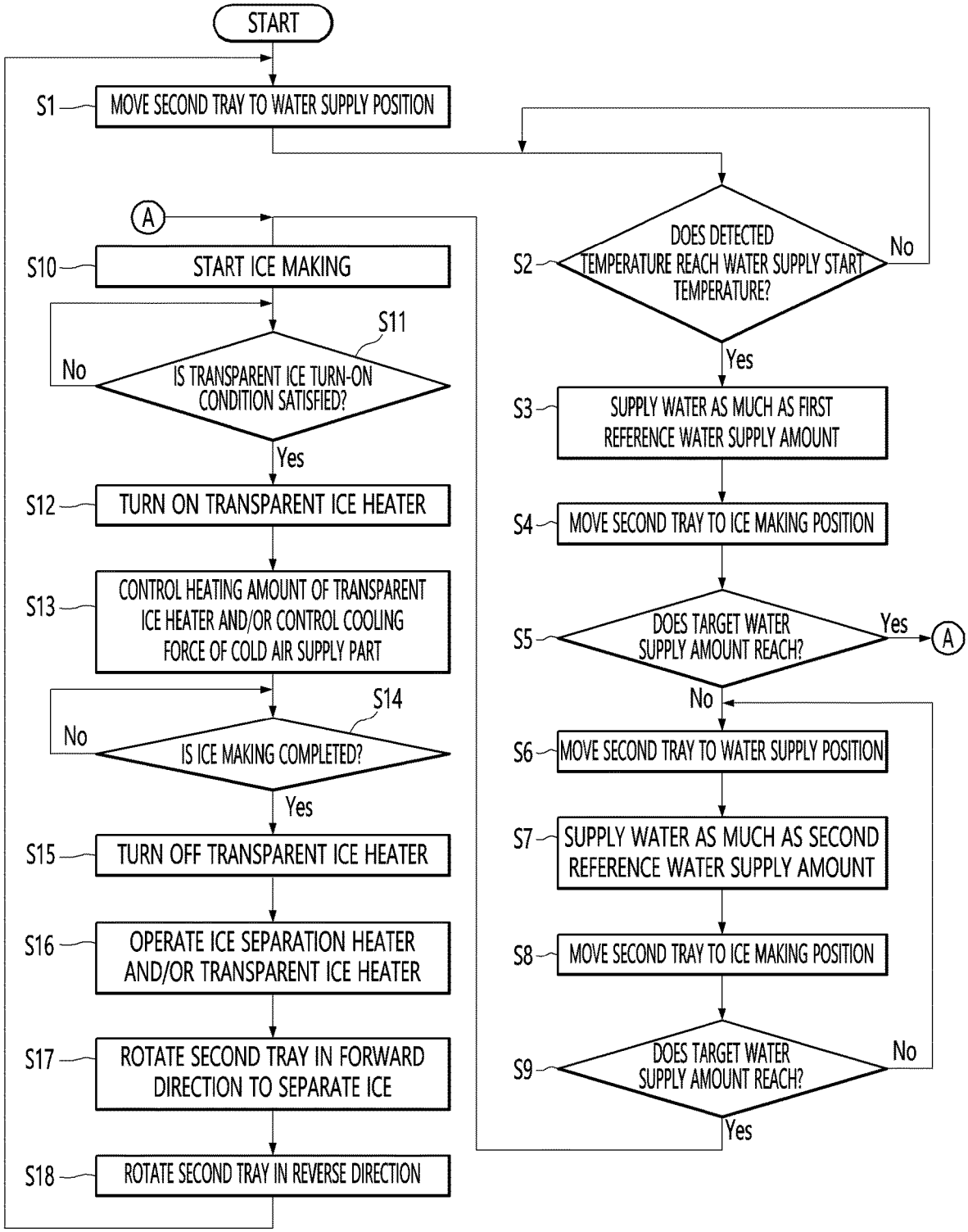
FIG. 7 is a flowchart for explaining a process of making ice in the ice maker according to an embodiment of the present invention.

FIG. 7 is a flowchart for explaining a process of making ice in the ice maker according to an embodiment.

Figure 8A:
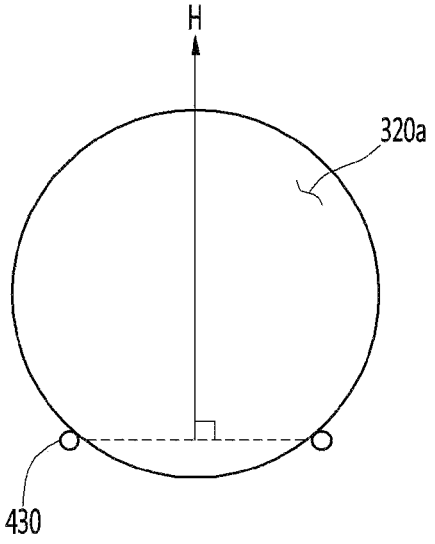
FIG. 8 is a view for explaining a height reference depending on a relative position of the transparent heater with respect to the ice making cell.
Figure 8B:
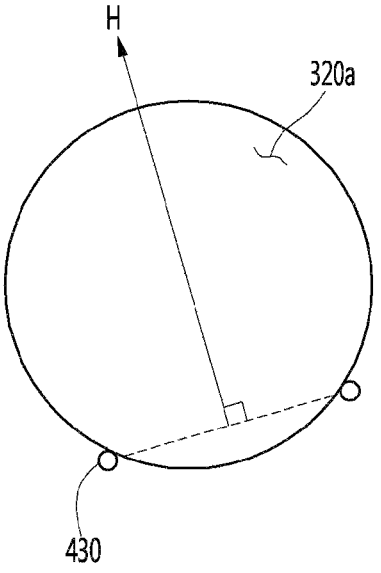
Figure 9A:
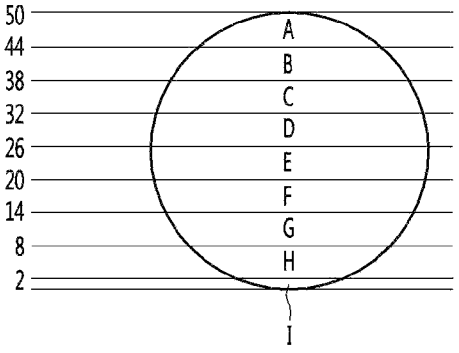
FIG. 9 is a view for explaining an output of the transparent heater per unit height of water within the ice making cell.
Figure 9B:
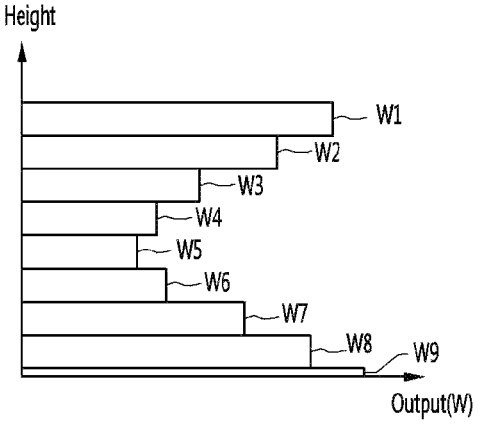

FIG. 8 is a view for explaining a height reference depending on a relative position of the transparent heater with respect to the ice making cell, and FIG. 9 is a view for explaining an output of the transparent heater per unit height of water within the ice making cell.

Figure 10:
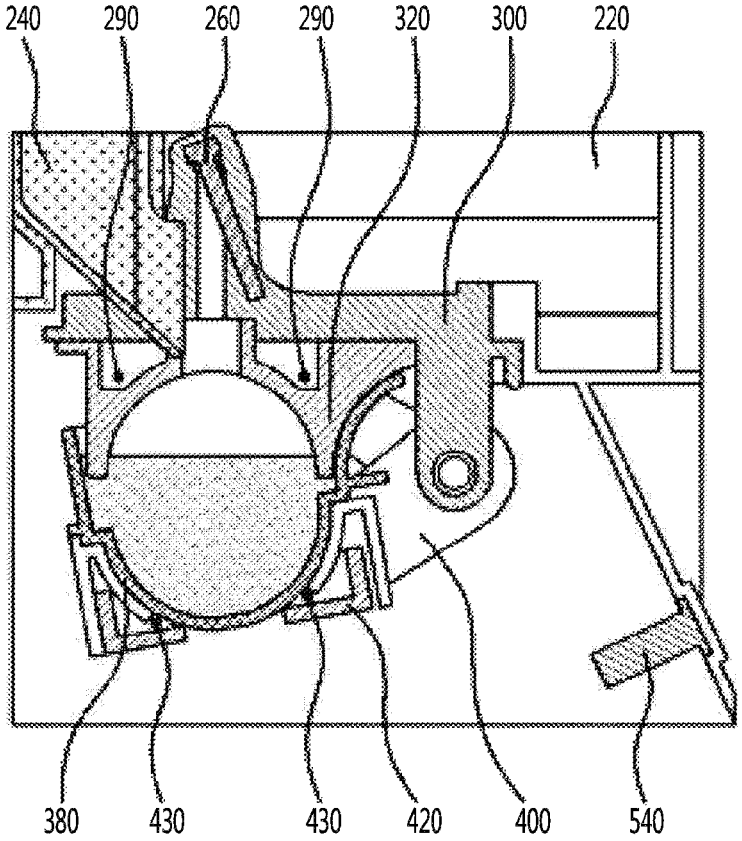
FIG. 10 is a view illustrating a state in which water supply is complete.
Figure 11:
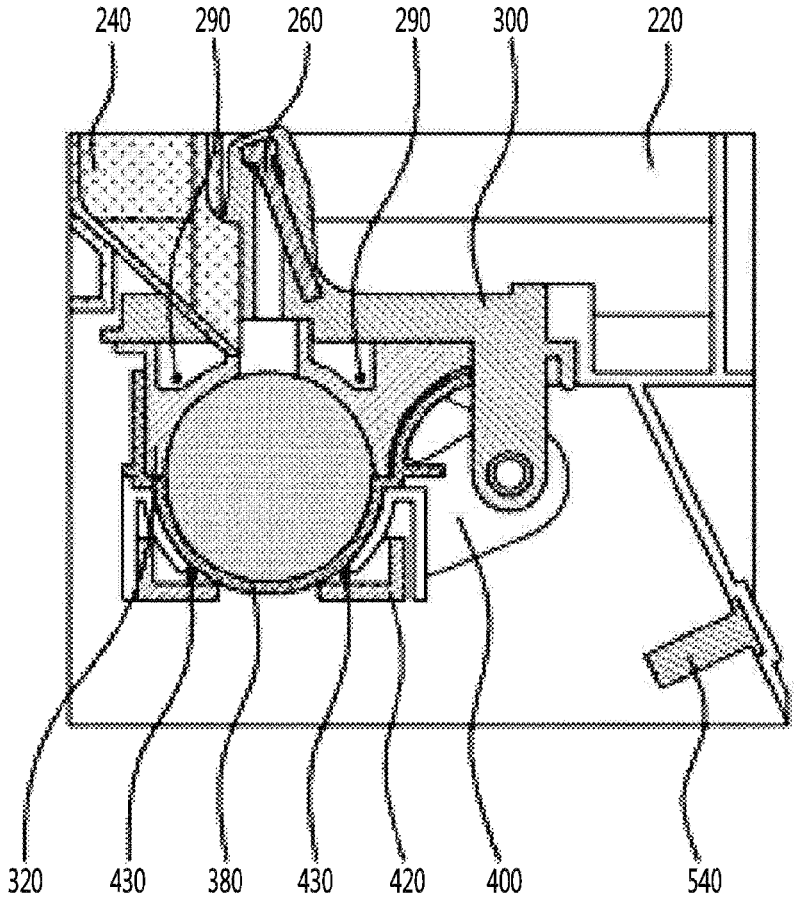
FIG. 11 is a view illustrating a state in which ice is generated at an ice making position.
Figure 12:
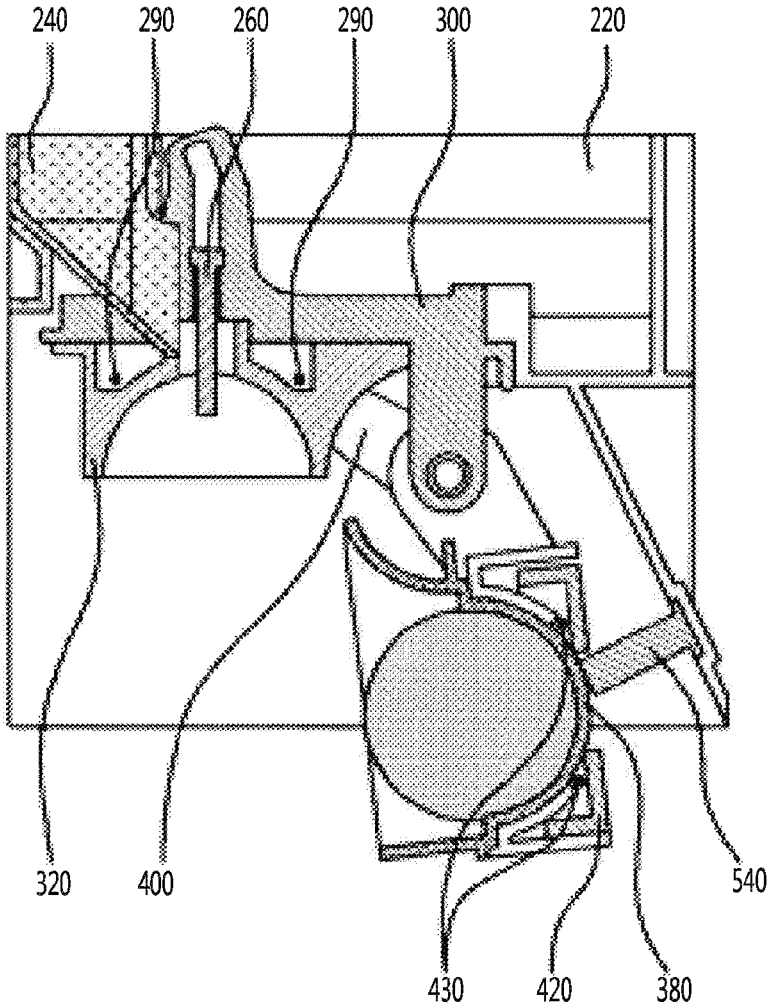
FIG. 12 is a view illustrating a state in which a second tray and a first tray are separated from each other in an ice separation process.
Figure 13:
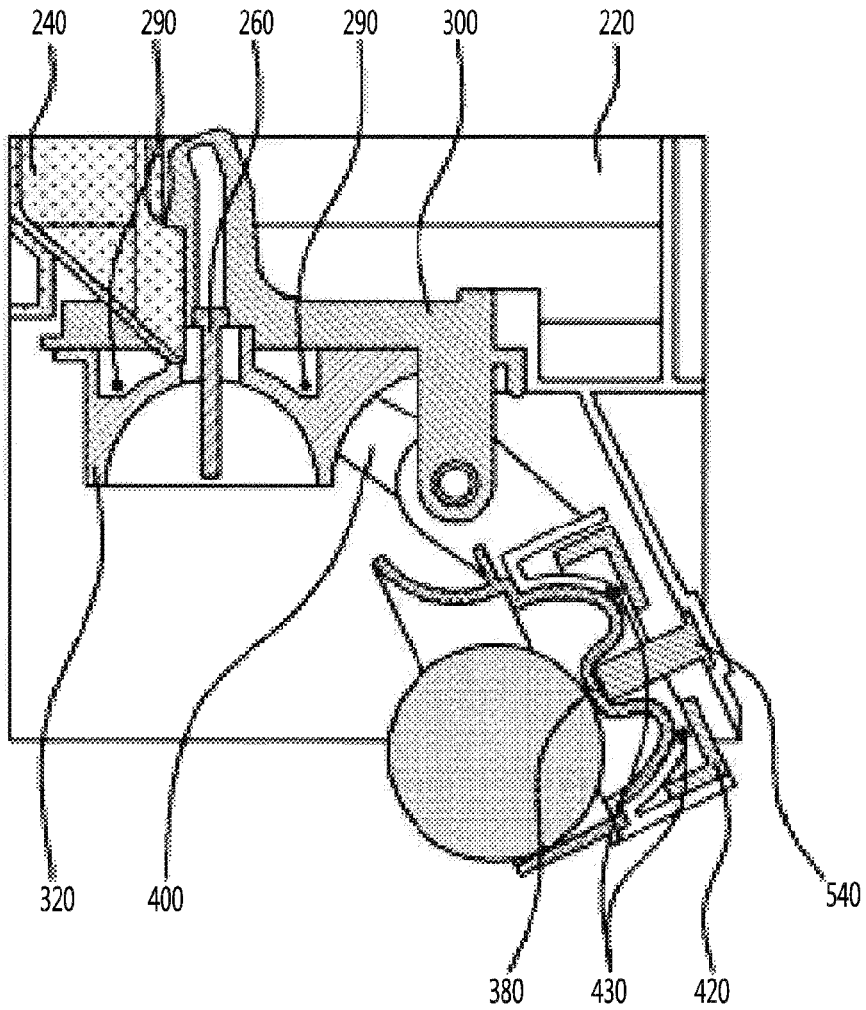
FIG. 13 is a view illustrating a state in which the second tray moves to an ice separation position in the ice separation process.

FIG. 10 is a view illustrating a state in which the water as much as a first reference water supply amount is supplied at the water supply position, FIG. 11 is a view illustrating a state in which ice is generated at the ice making position, FIG. 12 is a view illustrating a state in which the second tray and the first tray are separated from each other in an ice separation process, and FIG. 13 is a view illustrating a state in which the second tray moves to the ice separation position in the ice separation process.

Referring to FIGS. 6 to 13, to make ice in the ice maker 200, the controller 800 moves the second tray 380 to a water supply position (51).

In this specification, a direction in which the second tray 380 moves from the ice making position of FIG. 11 to the ice separation position of FIG. 13 may be referred to as forward movement (or forward rotation). On the other hand, the direction from the ice separation position of FIG. 13 to the water supply position of FIG. 10 may be referred to as reverse movement (or reverse rotation).

The movement to the water supply position of the second tray 380 is detected by a sensor (not shown), and when it is detected that the second tray 380 moves to the water supply position, the controller 800 stops the driver 480.

In a state in which the second tray 380 moves to the water supply position, the controller 800 may determine whether the temperature detected by the second temperature sensor 700 reaches a temperature below the water supply start temperature (S2).

As described later, after the ice making is completed, the ice separation heater and/or the ice making heater 430 operate to separate ice. Heat from the ice separation heater and/or the ice making heater 430 is provided to the ice making cell 320*a*. The temperature detected by the second temperature sensor 700 may increase to a temperature higher than a temperature that is above zero due to the heat provided to the ice making cell 320*a*.

If the water supply starts immediately after the ice separation is completed, it is determined that the temperature detected by the second temperature sensor 700 reaches a water supply start temperature by an effect of heat of the heater even though water as much as the target water supply amount has not been supplied to the ice making cell 320*a*.

In this case, when ice making starts in a state in which water less than the target water supply amount is supplied, the completion of the ice making may be determined in a state in which the ice is not completely frozen, and the ice does not become transparent.

Accordingly, in this embodiment, the water supply does not start immediately after the ice separation is completed, but stands by so that the temperature detected by the second temperature sensor 700 decreases due to the cold air. When the temperature detected by the second temperature sensor 700 decreases to a temperature that is equal to or lower than the water supply start temperature, the water supply may start. As another example, the water supply may start when a set standby time elapses after the ice separation is completed. The set standby time may be set to a time so that the temperature detected by the second temperature sensor 700 is sufficiently lowered by the cold air. The water supply start temperature may be a temperature lower than the reference temperature. The water supply start temperature may be a sub-zero temperature.

As a result of the determination in operation S2, when it is determined that the temperature detected by the second temperature sensor 700 reaches a temperature equal to or less than the water supply start temperature, the controller 800 may control the water supply valve 242 to supply water as much as a first reference water supply amount.

In this embodiment, the first reference water supply amount is less than the target water supply amount.

In order to allow the impeller to rotate within the housing of the flow sensor, a gap exists between the impeller and an inner circumferential surface of the housing.

When the impeller rotates, a portion of water flows by the impeller, and the other portion is bypassed to flow through the gap between the impeller and the inner circumferential surface of the housing.

When the water pressure is higher than the reference water pressure, an amount of water flowing at the gap between the impeller and the inner circumferential surface of the housing is small. Thus, even if the number of pulses output in the rotation process of the impeller reaches the reference number corresponding to the target water supply amount, and the water supply valve is turned off, an actual water supply amount becomes almost the same as the target water supply amount.

However, when the water pressure is lower than the reference water pressure, an amount of water flowing through the gap between the impeller and the inner circumferential surface of the housing increases.

In this case, when the number of pulses output in the rotation process of the impeller reaches the reference number corresponding to the target water supply amount, and the water supply valve is turned off, the actual water supply amount is greater than the target water supply amount.

If the actual water supply amount is greater than the target water supply amount, since water is filled up to a position higher than the communication hole 321*e* of the ice making cell 320*a*, ice is generated up to the auxiliary storage chamber or protrudes outside the auxiliary storage chamber during the ice making process.

Thus, in this embodiment, considering that the refrigerator is installed in an area having a low water pressure, the first reference water supply amount may be set to be lower than the target water supply amount. In this case, even if water is supplied as much as the first reference water supply amount in a state in which the water pressure is low, the actual water supply amount may be equal to or less than the target water supply amount.

Also, when a filter provided on a passage through which water flows is replaced, or at an initial stage of operation after purchasing the refrigerator, the passage may not be completely filled with water, and air may be contained.

When water and air are contained in the passage, even if the water supply is performed as much as the first reference water supply amount, the actual water supply amount may be less than the first reference water supply amount. If the ice making starts immediately in this state, it may be determined that the ice making is completed in a state in which ice is not completely frozen, and the ice may not become transparent.

The controller 800 turns on the water supply valve 242 for water supply, and when the number of pulses output from the flow sensor 244 reaches a first reference number corresponding to the first reference water supply amount, the water supply valve 242 is turned off.

After supplying the water by the first reference water supply amount, the controller 800 controls the driver 480 to allow the second tray 380 to move to the ice making position (S3).

At this time, after water as much as the first reference water supply amount is supplied, the driver 480 may be controlled so that the second tray 380 moves to the ice making position after standing by for a standby time until water is distributed to the plurality of ice making cells 320*a*.

For example, the controller 800 may control the driver 480 to allow the second tray 380 to move from the water supply position in the reverse direction. When the second tray 380 move in the reverse direction, the top surface 381*a* of the second tray 380 comes close to the bottom surface 321*e* of the first tray 320. Then, water between the top surface 381*a* of the second tray 380 and the bottom surface 321*e* of the first tray 320 is divided into each of the plurality of second cells 320*c* and then is distributed. When the top surface 381*a* of the second tray 380 and the bottom surface 321*e* of the first tray 320 contact each other, water is filled in the first cell 320*b*.

The movement to the ice making position of the second tray 380 is detected by a sensor, and when it is detected that the second tray 380 moves to the ice making position, the controller 800 stops the driver 480 (S4).

After the second tray 380 moves to the ice making position, the controller 800 may determine whether the actual water supply amount of the ice making cell 320*a* reaches a target water supply amount (S5). For example, it may be determined whether the temperature detected by the second temperature sensor 700 reaches a reference temperature within a set time.

As a result of determination in operation S5, if the temperature detected by the second temperature sensor 700 reaches the reference temperature, it is determined that the water supply amount reaches the target water supply amount, and the ice making may start. On the other hand, as a result of determination in operation S5, if the temperature detected by the second temperature sensor 700 does not reach the reference temperature, the controller 800 may perform additional water supply.

For example, the controller 800 may control the driver 480 so that the second tray 380 moves to the water supply position (S6).

At the water supply position of the second tray 380, the water supply valve 242 may be controlled so that water supply is performed as much as the second reference water supply amount (S7).

The second reference water supply amount is less than the first reference water supply amount.

The controller 800 turns on the water supply valve 242 for water supply, and when the number of pulses output from the flow sensor 244 reaches a second reference number corresponding to the second reference water supply amount, the water supply valve 242 is turned off.

After supplying the water by the second reference water supply amount, the controller 800 controls the driver 480 to allow the second tray 380 to move to the ice making position (S8).

For example, the controller 800 may control the driver 480 to allow the second tray 380 to move from the water supply position in the reverse direction.

After the second tray 380 moves to the ice making position, the controller 800 may determine whether the actual water supply amount of the ice making cell 320*a* reaches a target water supply amount (S9).

As a result of the determination in operation S9, when it is determined that the actual water supply amount of the ice-making cell 320*a* reaches the target water supply amount, the controller 800 starts the ice making. On the other hand, as a result of determination in operation S9, if the actual water supply amount of the ice making cell 320*a* does not reach the target water supply amount, the controller 800 performs the additional water supply again.

That is, in this embodiment, after the first water supply, the additional water supply may be repetitively performed until the water supply amount to the ice making cell reaches the target water supply amount. In this specification, the first water supply process may be used as a basic water supply process. Then, the present invention may include a basic water supply process and one or more additional water supply processes.

Although not limited, the first reference water supply amount may be set to 80% or more of the target water supply amount. The second reference water supply amount may be set to 20% or less of the target water supply amount. While the number of times of additional water supply decreases as the second reference water supply amount increases, there is a high possibility that the actual water supply amount exceeds the target water supply amount after the additional water supply. On the other hand, as the second reference water supply amount decreases, the water supply may be precisely adjusted, whereas the number of additional water supply may increase.

In this embodiment, in order to minimize the increase in number of additional water supply while the actual water supply amount does not exceed the target water supply amount, the second water supply amount may be set within a range of 1% to 10% of the target water supply amount. Preferably, the reference water supply amount may be set to 90% or more of the target water supply amount.

In the state in which the second tray 380 moves to the ice making position, ice making is started (S10).

For example, the ice making may be started when the second tray 380 reaches the ice making position. Alternatively, when the second tray 380 reaches the ice making position, and the predetermined time elapses after the water supply is completed, the ice making may be started.

When ice making is started, the controller 800 may control the cold air supply part 900 to supply cold air to the ice making cell 320*a*.

After the ice making is started, the controller 800 may control the transparent ice heater 430 to be turned on in at least partial sections of the cold air supply part 900 supplying the cold air to the ice making cell 320*a*.

When the transparent ice heater 430 is turned on, since the heat of the transparent ice heater 430 is transferred to the ice making cell 320*a*, the ice making rate of the ice making cell 320*a* may be delayed.

According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied (S11).

In this embodiment, the transparent ice heater 430 is not turned on immediately after the ice making is started, and the transparent ice heater 430 may be turned on only when the turn-on condition of the transparent ice heater 430 is satisfied (S12).

Generally, the water supplied to the ice making cell 320*a* may be water having normal temperature or water having a temperature lower than the normal temperature. The temperature of the water supplied is higher than a freezing point of water.

Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice.

If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice.

Thus, according to this embodiment, after the turn-on condition of the transparent ice heater 430 is satisfied, when the transparent ice heater 430 is turned on, power consumption due to the unnecessary operation of the transparent ice heater 430 may be prevented.

Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on. For example, the specific time point may be set to a time point at which the cold air supply part 900 starts to supply cooling power for the ice making, a time point at which the second tray 380 reaches the ice making position, a time point at which the water supply is completed, and the like.

Alternatively, the controller 800 determines that the turn-on condition of the transparent ice heater 430 is satisfied when a temperature detected by the second temperature sensor 700 reaches a turn-on reference temperature.

For example, the turn-on reference temperature may be a temperature for determining that water starts to freeze at the uppermost side (communication hole-side) of the ice making cell 320*a*. When a portion of the water is frozen in the ice making cell 320*a*, the temperature of the ice in the ice making cell 320*a* is below zero.

The temperature of the first tray 320 may be higher than the temperature of the ice in the ice making cell 320*a*.

Alternatively, although water exists in the ice making cell 320*a*, after the ice starts to be made in the ice making cell 320*a*, the temperature detected by the second temperature sensor 700 may be below zero.

Thus, to determine that making of ice is started in the ice making cell 320*a* on the basis of the temperature detected by the second temperature sensor 700, the turn-on reference temperature may be set to the below-zero temperature.

That is, when the temperature sensed by the second temperature sensor 700 reaches the turn-on reference temperature, since the turn-on reference temperature is below zero, the ice temperature of the ice making cell 320*a* is below zero, i.e., lower than the below reference temperature. Therefore, it may be indirectly determined that ice is made in the ice making cell 320*a*.

As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water.

Since density of water is greater than that of ice, water or bubbles may be convex in the ice making cell 320*a*, and the bubbles may move to the transparent ice heater 430.

In this embodiment, the mass (or volume) per unit height of water in the ice making cell 320*a* may be the same or different according to the shape of the ice making cell 320*a*. For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

When the cooling power of the cold air supply part 900 is constant, if the heating amount of the transparent ice heater 430 is the same, since the mass per unit height of water in the ice making cell 320*a* is different, an ice making rate per unit height may be different.

For example, if the mass per unit height of water is small, the ice making rate is high, whereas if the mass per unit height of water is high, the ice making rate is slow.

As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency.

That is, the more the variation in ice making rate per unit height of water decreases, the more the variation in transparency per unit height of made ice may decrease.

Therefore, in this embodiment, the controller 800 may control the cooling power and/or the heating amount so that the cooling power of the cold air supply part 900 and/or the heating amount of the transparent ice heater 430 is variable according to the mass per unit height of the water of the ice making cell 320*a* (S13).

In this specification, the variable of the cooling power of the cold air supply part 900 may include one or more of a variable output of the compressor, a variable output of the fan, and a variable opening degree of the refrigerant valve.

Also, in this specification, the variation in the heating amount of the transparent ice heater 430 may represent varying the output of the transparent ice heater 430 or varying the duty of the transparent ice heater 430.

In this case, the duty of the transparent ice heater 430 represents a ratio of the turn-on time and the turn-off time of the transparent ice heater 430 in one cycle, or a ratio of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430.

For example, as shown in (a) FIG. 8, the transparent ice heater 430 at the bottom surface of the ice making cell 320*a* may be disposed to have the same height. In this case, a line connecting the transparent ice heater 430 is a horizontal line, and a line extending in a direction perpendicular to the horizontal line serves as a reference for the unit height of the water of the ice making cell 320*a*.

In the case of (a) FIG. 8, ice is made from the uppermost side of the ice making cell 320*a* and then is grown. On the other hand, as shown in (b) FIG. 8, the transparent ice heater 430 at the bottom surface of the ice making cell 320*a* may be disposed to have different heights. In this case, since heat is supplied to the ice making cell 320*a* at different heights of the ice making cell 320*a*, ice is made with a pattern different from that of (a) of FIG. 8.

For example, in (b) of FIG. 8, ice may be made at a position spaced apart from the uppermost end to the left side of the ice making cell 320*a*, and the ice may be grown to a right lower side at which the transparent ice heater 430 is disposed.

Accordingly, in (b) of FIG. 8, a line (reference line) perpendicular to the line connecting two points of the transparent ice heater 430 serves as a reference for the unit height of water of the ice making cell 320*a*. The reference line of (b) of FIG. 8 is inclined at a predetermined angle from the vertical line.

FIG. 9 illustrates a unit height division of water and an output amount of transparent ice heater per unit height when the transparent ice heater is disposed as shown in (a) of FIG. 8.

Hereinafter, an example of controlling an output of the transparent ice heater so that the ice making rate is constant for each unit height of water will be described.

Referring to FIG. 9, when the ice making cell 320*a* is formed, for example, in a spherical shape, the mass per unit height of water in the ice making cell 320*a* increases from the upper side to the lower side to reach the maximum and then decreases again.

For example, the water (or the ice making cell itself) in the spherical ice making cell 320*a* having a diameter of about 50 mm is divided into nine sections (section A to section I) by 6 mm height (unit height). Here, it is noted that there is no limitation on the size of the unit height and the number of divided sections.

When the water in the ice making cell 320*a* is divided into unit heights, the height of each section to be divided is equal to the section A to the section H, and the section I is lower than the remaining sections. Alternatively, the unit heights of all divided sections may be the same depending on the diameter of the ice making cell 320*a* and the number of divided sections.

Among the many sections, the section E is a section in which the mass of unit height of water is maximum. For example, in the section in which the mass per unit height of water is maximum, when the ice making cell 320*a* has spherical shape, a diameter of the ice making cell 320*a*, a horizontal cross-sectional area of the ice making cell 320*a*, or a circumference of the ice may be maximum.

As described above, when assuming that the cooling power of the cold air supply part 900 is constant, and the output of the transparent ice heater 430 is constant, the ice making rate in section E is the lowest, the ice making rate in the sections A and I is the fastest.

In this case, since the ice making rate varies for the height, the transparency of the ice may vary for the height. In a specific section, the ice making rate may be too fast to contain bubbles, thereby lowering the transparency.

Therefore, in this embodiment, the output of the transparent ice heater 430 may be controlled so that the ice making rate for each unit height is the same or similar while the bubbles move from the portion at which ice is made to the water in the ice making process.

Specifically, since the mass of the section E is the largest, the output W5 of the transparent ice heater 430 in the section E may be set to a minimum value.

Since the volume of the section D is less than that of the section E, the volume of the ice may be reduced as the volume decreases, and thus it is necessary to delay the ice making rate.

Thus, an output W6 of the transparent ice heater 430 in the section D may be set to a value greater than an output W5 of the transparent ice heater 430 in the section E. Since the volume in the section C is less than that in the section D by the same reason, an output W3 of the transparent ice heater 430 in the section C may be set to a value greater than the output W4 of the transparent ice heater 430 in the section D. Since the volume in the section B is less than that in the section C, an output W2 of the transparent ice heater 430 in the section B may be set to a value greater than the output W3 of the transparent ice heater 430 in the section C. Since the volume in the section A is less than that in the section B, an output W1 of the transparent ice heater 430 in the section A may be set to a value greater than the output W2 of the transparent ice heater 430 in the section B.

For the same reason, since the mass per unit height decreases toward the lower side in the section E, the output of the transparent ice heater 430 may increase as the lower side in the section E (see W6, W7, W8, and W9).

Thus, according to an output variation pattern of the transparent ice heater 430, the output of the transparent ice heater 430 is gradually reduced from the first section to the intermediate section after the transparent ice heater 430 is initially turned on.

The output of the transparent ice heater 430 may be minimum in the intermediate section in which the mass of unit height of water is minimum. The output of the transparent ice heater 430 may again increase step by step from the next section of the intermediate section.

The output of the transparent ice heater 430 in two adjacent sections may be set to be the same according to the type or mass of the made ice. For example, the output of section C and section D may be the same. That is, the output of the transparent ice heater 430 may be the same in at least two sections.

Alternatively, the output of the transparent ice heater 430 may be set to the minimum in sections other than the section in which the mass per unit height is the smallest.

For example, the output of the transparent ice heater 430 in the section D or the section F may be minimum. The output of the transparent ice heater 430 in the section E may be equal to or greater than the minimum output.

In summary, in this embodiment, the output of the transparent ice heater 430 may have a maximum initial output. In the ice making process, the output of the transparent ice heater 430 may be reduced to the minimum output of the transparent ice heater 430.

The output of the transparent ice heater 430 may be gradually reduced in each section, or the output may be maintained in at least two sections.

The output of the transparent ice heater 430 may increase from the minimum output to the end output. The end output may be the same as or different from the initial output.

In addition, the output of the transparent ice heater 430 may incrementally increase in each section from the minimum output to the end output, or the output may be maintained in at least two sections.

Alternatively, the output of the transparent ice heater 430 may be an end output in a section before the last section among a plurality of sections. In this case, the output of the transparent ice heater 430 may be maintained as an end output in the last section. That is, after the output of the transparent ice heater 430 becomes the end output, the end output may be maintained until the last section.

As the ice making is performed, an amount of ice existing in the ice making cell 320*a* may decrease. Thus, when the transparent ice heater 430 continues to increase until the output reaches the last section, excessive heat is supplied to the ice making cell 320*a*. As a result, water may exist in the ice making cell 320*a* even after the end of the last section.

Therefore, the output of the transparent ice heater 430 may be maintained as the end output in at least two sections including the last section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

As described above, even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small.

For example, while maintaining the same cooling power of the cold air supply part 900, the heating amount of the transparent ice heater 430 may vary so as to be inversely proportional to the mass per unit height of water.

Also, it is possible to make the transparent ice by varying the cooling power of the cold air supply part 900 according to the mass per unit height of water.

For example, when the mass per unit height of water is large, the cold force of the cold air supply part 900 may increase, and when the mass per unit height is small, the cold force of the cold air supply part 900 may decrease.

For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may gradually increase.

The cooling power of the cold air supply part 900 may be maximum in the intermediate section in which the mass for each unit height of water is minimum. The cooling power of the cold air supply part 900 may be gradually reduced again from the next section of the intermediate section.

Alternatively, the transparent ice may be made by varying the cooling power of the cold air supply part 900 and the heating amount of the transparent ice heater 430 according to the mass for each unit height of water.

For example, the heating power of the transparent ice heater 430 may vary so that the cooling power of the cold air supply part 900 is proportional to the mass per unit height of water and inversely proportional to the mass for each unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

The controller 800 may determine whether the ice making is completed based on the temperature sensed by the second temperature sensor 700 (S14). When the temperature detected by the second temperature sensor 700 reaches an end reference temperature, the controller 800 may determine that ice making is completed.

When it is determined that the ice making is completed, the controller 800 may turn off the transparent ice heater 430 (S26).

For example, when the temperature sensed by the second temperature sensor 700 reaches a first reference temperature, the controller 800 may determine that the ice making is completed to turn off the transparent ice heater 430.

In this case, since a distance between the second temperature sensor 700 and each ice making cell 320*a* is different, in order to determine that the ice making is completed in all the ice making cells 320*a*, the controller 800 may perform the ice separation after a certain amount of time, at which it is determined that ice making is completed, has passed or when the temperature sensed by the second temperature sensor 700 reaches a second reference temperature lower than the first reference temperature.

When the ice making is completed, the controller 800 operates one or more of the ice separation heater 290 and the transparent ice heater 430 (S16).

When at least one of the ice separation heater 290 or the transparent ice heater 430 is turned on, heat of the heater is transferred to at least one of the first tray 320 or the second tray 380 so that the ice may be separated from the surfaces (inner surfaces) of one or more of the first tray 320 and the second tray 380.

Also, the heat of the heaters 290 and 430 is transferred to the contact surface of the first tray 320 and the second tray 380, and thus, the lower surface 321*d* of the first tray 320 and the upper surface 381*a* of the second tray 380 may be in a state capable of being separated from each other.

When at least one of the ice separation heater 290 and the transparent ice heater 430 operate for a predetermined time, or when the temperature sensed by the second temperature sensor 700 is equal to or higher than an off reference temperature, the controller 800 is turned off the heaters 290 and 430, which are turned on. Although not limited, the turn-off reference temperature may be set to above zero temperature.

The controller 800 operates the driver 480 to allow the second tray 380 to move in the forward direction (S17). As illustrated in FIG. 12, when the second tray 380 move in the forward direction, the second tray 380 is spaced apart from the first tray 320.

The moving force of the second tray 380 is transmitted to the first pusher 260 by the pusher link 500. Then, the first pusher 260 descends along the guide slot 302, and the extension part 264 passes through the communication hole 321*e* to press the ice in the ice making cell 320*a*.

In this embodiment, ice may be separated from the first tray 320 before the extension part 264 presses the ice in the ice making process. That is, ice may be separated from the surface of the first tray 320 by the heater that is turned on.

In this case, the ice may move together with the second tray 380 while the ice is supported by the second tray 380.

For another example, even when the heat of the heater is applied to the first tray 320, the ice may not be separated from the surface of the first tray 320.

Therefore, when the second tray 380 moves in the forward direction, there is possibility that the ice is separated from the second tray 380 in a state in which the ice contacts the first tray 320.

In this state, in the process of moving the second tray 380, the extension part 264 passing through the communication hole 320*e* of the first tray 320 may press the ice contacting the first tray 320, and thus, the ice may be separated from the tray 320.

The ice separated from the first tray 320 may be supported by the second tray 380 again.

When the ice moves together with the second tray 380 while the ice is supported by the second tray 380, the ice may be separated from the tray 250 by its own weight even if no external force is applied to the second tray 380.

While the second tray 380 moves, even if the ice does not fall from the second tray 380 by its own weight, when the second pusher 540 presses the second tray 540 as illustrated in FIG. 13, the ice may be separated from the second tray 380 to fall downward.

For example, as illustrated in FIG. 12, while the second tray 380 moves in the forward direction, the second tray 380 may contact the extension part 544 of the second pusher 540. When the second tray 380 continuously moves in the forward direction, the extension part 544 may press the second tray 380 to deform the second tray 380 and the extension part 544. Thus, the pressing force of the extension part 544 may be transferred to the ice so that the ice is separated from the surface of the second tray 380. The ice separated from the surface of the second tray 380 may drop downward and be stored in the ice bin 600.

In this embodiment, as shown in FIG. 13, the position at which the second tray 380 is pressed by the second pusher 540 and deformed may be referred to as an ice separation position.

Whether the ice bin 600 is full may be detected while the second tray 380 moves from the ice making position to the ice separation position.

For example, the full ice detection lever 520 rotates together with the second tray 380, and the rotation of the full ice detection lever 520 is interrupted by ice while the full ice detection lever 520 rotates. In this case, it may be determined that the ice bin 600 is in a full ice state. On the other hand, if the rotation of the full ice detection lever 520 is not interfered with the ice while the full ice detection lever 520 rotates, it may be determined that the ice bin 600 is not in the full ice state.

After the ice is separated from the second tray 380, the controller 800 controls the driver 480 to allow the second tray 380 to move in the reverse direction (S18). Then, the second tray assembly 211 moves from the ice separation position to the water supply position.

When the second tray 380 moves to the water supply position of FIG. 10, the controller 800 stops the driver 480.

When the second tray 380 is spaced apart from the extension part 544 while the second tray 380 moves in the reverse direction, the deformed second tray 380 may be restored to its original shape.

In the reverse movement of the second tray 380, the moving force of the second tray 380 is transmitted to the first pusher 260 by the pusher link 500, and thus, the first pusher 260 ascends, and the extension part 264 is removed from the ice making cell 320*a*.

In the present embodiment, cooling power of the cold air supply part 900 may be determined corresponding to the target temperature of the freezing compartment 32. The cold air generated by the cold air supply part 900 may be supplied to the freezing chamber 32.

The water of the ice making cell 320*a* may be phase-changed into ice by heat transfer between the cold water supplied to the freezing chamber 32 and the water of the ice making cell 320*a*.

In this embodiment, a heating amount of the transparent ice heater 430 for each unit height of water may be determined in consideration of predetermined cooling power of the cold air supply part 900.

In this embodiment, the heating amount of the transparent ice heater 430 determined in consideration of the predetermined cooling power of the cold air supply part 900 is referred to as a reference heating amount. The magnitude of the reference heating amount per unit height of water is different.

However, when the amount of heat transfer between the cold of the freezing compartment 32 and the water in the ice making cell 320*a* is variable, if the heating amount of the transparent ice heater 430 is not adjusted to reflect this, the transparency of ice for each unit height varies.

In this embodiment, the case in which the heat transfer amount between the cold and the water increase may be a case in which the cooling power of the cold air supply part 900 increases or a case in which the air having a temperature lower than the temperature of the cold air in the freezing compartment 32 is supplied to the freezing compartment 32.

On the other hand, the case in which the heat transfer amount between the cold and the water decrease may be a case in which the cooling power of the cold air supply part 900 decreases or a case in which the air having a temperature higher than the temperature of the cold air in the freezing compartment 32 is supplied to the freezing compartment 32.

For example, a target temperature of the freezing compartment 32 is lowered, an operation mode of the freezing compartment 32 is changed from a normal mode to a rapid cooling mode, an output of at least one of the compressor or the fan increases, or an opening degree increases, the cooling power of the cold air supply part 900 may increase.

On the other hand, the target temperature of the freezer compartment 32 increases, the operation mode of the freezing compartment 32 is changed from the rapid cooling mode to the normal mode, the output of at least one of the compressor or the fan decreases, or the opening degree of the refrigerant valve decreases, the cooling power of the cold air supply part 900 may decrease.

When the cooling power of the cold air supply part 900 increases, the temperature of the cold air around the ice maker 200 is lowered to increase in ice making rate.

On the other hand, if the cooling power of the cold air supply part 900 decreases, the temperature of the cold air around the ice maker 200 increases, the ice making rate decreases, and also, the ice making time increases.

Therefore, in this embodiment, when the amount of heat transfer of cold and water increases so that the ice making rate is maintained within a predetermined range lower than the ice making rate when the ice making is performed with the transparent ice heater 430 that is turned off, the heating amount of transparent ice heater 430 may be controlled to increase.

On the other hand, when the amount of heat transfer between the cold and the water decreases, the heating amount of transparent ice heater 430 may be controlled to decrease.

In this embodiment, when the ice making rate is maintained within the predetermined range, the ice making rate is less than the rate at which the bubbles move in the portion at which the ice is made, and no bubbles exist in the portion at which the ice is made.

When the cooling power of the cold air supply part 900 increases, the heating amount of transparent ice heater 430 may increase. On the other hand, when the cooling power of the cold air supply part 900 decreases, the heating amount of transparent ice heater 430 may decrease.

Hereinafter, the case in which the target temperature of the freezing compartment 32 varies will be described with an example.

The controller 800 may control the output of the transparent ice heater 430 so that the ice making rate may be maintained within the predetermined range regardless of the target temperature of the freezing compartment 32.

For example, the ice making may be started, and a change in heat transfer amount of cold and water may be detected. For example, it may be sensed that the target temperature of the freezing compartment 32 is changed through an input part (not shown).

The controller 800 may determine whether the heat transfer amount of cold and water increases. For example, the controller 800 may determine whether the target temperature increases. When the target temperature increases, the controller 800 may decrease the reference heating amount of transparent ice heater 430 that is predetermined in each of the current section and the remaining sections. The variable control of the heating amount of the transparent ice heater 430 may be normally performed until the ice making is completed. On the other hand, if the target temperature decreases, the controller 800 may increase the reference heating amount of transparent ice heater 430 that is predetermined in each of the current section and the remaining sections. The variable control of the heating amount of the transparent ice heater 430 may be normally performed until the ice making is completed (S35). In this embodiment, the reference heating mount that increases or decreases may be predetermined and then stored in a memory.

According to this embodiment, the reference heating amount for each section of the transparent ice heater increases or decreases in response to the change in the heat transfer amount of cold and water, and thus, the ice making rate may be maintained within the predetermined range, thereby realizing the uniform transparency for each unit height of the ice.

Another embodiment will be described.

In the above embodiment, it is determined whether the water supply amount to the ice making cell reaches the target water supply amount based on the temperature detected by the second temperature sensor. Unlike this, the water supply amount detection part configured to detect the water supply amount may be further provided as a component that is provided separately from the second temperature sensor.

The water supply amount detection part may be, for example, a capacitive sensor. A signal (first signal) output from the water supply amount detection part when the water supply amount detection part is in contact with water, and a signal (second signal) output from the water supply amount detection part when the water supply amount detection part is not in contact with water are different from each other. Thus, when the first signal is output from the water supply amount detection part, the controller may determine that the water supply amount of the ice making cell reaches the target water supply amount.

In order that the water supply amount detection part is in contact with water, the water supply amount detection part may be exposed to the ice making cell. An end of the water supply amount detection part, which is in contact with water, may be disposed lower than the upper end of the ice making cell.

In this specification, the second temperature sensor may also be referred to as a water supply amount detection part.

The invention claimed is:

1. A refrigerator comprising:

a first tray having a first portion of a cell;

a second tray having a second portion of the cell, the second tray being movable relative to the first tray, and the first portion and the second portion being configured to define a space of the cell to receive a liquid to be phase-changed to form ice;

a liquid supply valve configured to adjust a flow of the liquid to the cell;

a detector configured to detect an amount of the liquid in the space of the cell, and a controller configured to:

control the liquid supply valve to supply a first amount of the liquid to the second tray when the second tray is at a liquid supply position, determine whether the amount of the liquid in the space of the cell is at least a target amount when the second tray moves to an ice making position to contact the first tray such that the first and second portions of the cell form the space for an ice making process, start the ice making process when the amount of the liquid in the space of the cell is at least the target amount, and move again the second tray from the ice making position to the liquid supply position and control the liquid supply valve to additionally supply up to a second amount of the liquid, that is less than the first amount of the liquid, to the second tray when the amount of the liquid in the space of the cell is less than the target amount.

2. The refrigerator of claim 1, wherein, after the liquid supply valve supplies the second amount of the liquid, the controller moves the second tray to the ice making position and determines whether the amount of the liquid in the cell is at least the target amount.

3. The refrigerator of claim 2, wherein, when the amount of the liquid in the cell is at least the target amount, the controller starts the ice making process, and when the amount of liquid in the cell is less that the target amount after the second amount is supplied, the second tray moves to the liquid supply position and the liquid supply valve is controlled to additionally supply as much as the second reference liquid supply amount one or more times until the amount of the liquid in the reaches the target amount.

4. The refrigerator of claim 1, wherein the liquid supply amount detector is positioned at an interior surface of the cell, or the liquid supply amount detector is mounted on the first tray.

5. The refrigerator of claim 1, wherein an upper end of the detector is positioned lower than an upper end of the cell.

6. The refrigerator of claim 1, wherein after the first or the second amount of the liquid is supplied to the second tray, the second tray moves from the liquid supply position to the ice making position in a reverse direction, the second tray moves to an ice separation position in a forward direction for an ice separation process to separate the ice from the cell after completion of the ice making process, and the controller controls the liquid supply valve to start supplying the first amount of the liquid when the second tray moves from the ice separation position to the liquid supply position in the reverse direction after completion of the ice separation process.

7. The refrigerator of claim 6, wherein the detector includes a temperature sensor configured to detect a temperature in the space of the cell.

8. The refrigerator of claim 7, wherein, when the second tray moves to the liquid supply position after the ice separation is completed, the controller controls the liquid supply valve to supply the first amount of the liquid to space of the cell when the temperature in the space of the cell is less than or equal to a liquid supply start temperature.

9. The refrigerator of claim 7, wherein the controller determines that amount of the liquid in the cell reaches the target amount when the temperature in cell is greater than or equal to a reference temperature that is above zero degrees Celsius.

10. The refrigerator of claim 1, wherein the detector includes a capacitive sensor that outputs different signals according to whether the capacitive sensor is in contact with the liquid.

11. The refrigerator of claim 10, wherein:

when the capacitive sensor is in contact with the liquid, a first signal is output, when the capacitive sensor is not in contact with the liquid, a second signal is output, and the controller determines that the amount of the liquid supplied to the cell reaches the target amount when the first signal is output from the capacitive sensor.

12. The refrigerator of claim 1, wherein the first amount of the liquid is equal to or greater than 80% of the target amount of the liquid, and the second amount is equal to or less than 20% of the target amount of the liquid.

13. The refrigerator of claim 1, wherein the first reference of the liquid amount is equal to or greater than 90% of the target amount of the liquid, and the second reference amount ranges between 1% to 10% of the target amount of the liquid.

14. The refrigerator of claim 1, further comprising a heater configured to supply heat to the cell, wherein the controller controls the heater to be turned on while the ice is being formed so that gas bubbles dissolved in the liquid within the cell move from a portion of space where the liquid that has phase-changed into the ice to another portion of the space where the liquid is in a fluid state.

15. The refrigerator of claim 14, wherein the controller controls at least one of a cooling power or a heating amount of the heater to vary according to mass per unit height values of the liquid within, respectively, a plurality of sections of the cell.

16. A refrigerator comprising:

a liquid supply configured to supply a liquid;

a tray having a first portion and a second portion of a cell, the second portion being movable relative to the first portion, and the first portion and the second portion being configured to define a space of the cell where the liquid is received and phase-changed to form ice;

a sensor to detect when at least a target amount of the liquid is in the space of the cell, and a controller configured to:

determine whether at least the target amount of the liquid is in the space of the cell when the second portion is at an ice making position after a first amount of the liquid is supplied to the cell, when less than the target amount of the liquid is in the space of the cell, moves the second portion from the ice making position to a liquid supply position, additionally supply, one or more times, a second amount of the liquid to the space of the cell until the sensor determines that at least the target amount of the liquid is in the space of the cell, and move the second portion to contact the first portion and start the ice making process when the sensor determines that at least the target amount of the liquid is in the space of the cell.

17. The refrigerator of claim 16, wherein the sensor includes a temperature sensor provided to measure a temperature of a section of the cell, and the controller determines that the target amount of the liquid is in the space when the temperature sensor detects a change in the temperature of the section of the cell.

18. The refrigerator of claim 16, wherein the sensor includes a capacitance sensor provided to measure capacitance at a section of the cell, and the controller sensor determines that the target amount of the liquid is in the space when the capacitance sensor detects a change in the capacitance of the section of the cell.

19. The refrigerator of claim 16, wherein the sensor is mounted on the first portion.

20. A refrigerator comprising:

a liquid supply configured to supply a liquid;

a tray having a first portion and a second portion of a cell, the second portion being movable relative to the first portion, and the first portion and the second portion being configured to define a space of the cell where the liquid is received and phase-changed to form ice;

a sensor to detect an amount of the liquid in the space of the cell, and a heater provided adjacent to at least one of the first portion or the second portion of the cell, wherein:

the liquid supply supplies the liquid to the space of the cell one or more times while the first portion and the second portion are separated, until the sensor determines that at least a target amount of the liquid is in the space of the cell, and when at least the target amount of the liquid is in the space of the cell, and the heater is activated while the ice is forming in the space of the cell, and wherein the liquid is supplied when the second portion s at a first position to be spaced from the first portion, and the sensor detects whether at least the target a amount of the liquid is in the space of the cell when the second portion of the tray is at a second position where the first portion and second portion contact each other to form the space of the cell.

* * * * *